US011488521B2

(12) United States Patent
Choi et al.

(10) Patent No.: US 11,488,521 B2
(45) Date of Patent: Nov. 1, 2022

(54) CLOCK GENERATING CIRCUIT FOR DRIVING PIXEL

(71) Applicant: SILICON WORKS CO., LTD., Daejeon (KR)

(72) Inventors: Jin Ho Choi, Daejeon (KR); Jang Su Kim, Daejeon (KR); Tae Geun Kim, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 31 days.

(21) Appl. No.: 17/307,791

(22) Filed: May 4, 2021

(65) Prior Publication Data

US 2021/0350742 A1 Nov. 11, 2021

(30) Foreign Application Priority Data

May 11, 2020 (KR) ..... 10-2020-0055908

(51) Int. Cl.
*G09G 3/32* (2016.01)

(52) U.S. Cl.
CPC ..... *G09G 3/32* (2013.01); *G09G 2310/08* (2013.01); *G09G 2320/0693* (2013.01); *G09G 2330/021* (2013.01)

(58) Field of Classification Search
CPC ..... G09G 3/32; G09G 2310/08; G09G 2320/0693; G09G 2330/021
See application file for complete search history.

(56) References Cited

U.S. PATENT DOCUMENTS

2016/0123811 A1* 5/2016 Hegyi ..... G01J 3/0224 348/33
2016/0284263 A1* 9/2016 Ma ..... G11C 19/28
2018/0286336 A1* 10/2018 Wang ..... G02F 1/1343
2020/0035187 A1* 1/2020 Kim ..... G09G 3/3688
2020/0105211 A1* 4/2020 Huang ..... G09G 3/3614
2020/0403131 A1* 12/2020 Kim ..... H01L 25/0753

FOREIGN PATENT DOCUMENTS

KR 10-0627368 B1 9/2006
KR 10-2015-0095707 A 8/2015

* cited by examiner

*Primary Examiner* — Andrew Sasinowski
(74) *Attorney, Agent, or Firm* — Fenwick & West LLP

(57) ABSTRACT

When the frequency of a driving clock used to drive a pixel in a display device reaches a target frequency, some of delay circuits are disabled, thereby reducing power consumption for generating the driving clock.

20 Claims, 15 Drawing Sheets

350
Calibration initialization circuit
GCLK_MASK
INIT_GCLK_MASK
340
Calibration selection circuit
DCLK
WIN
CALB_ON
360
Delay disabling circuit
MUL_X
DLY_EN
DLY_IN
DLY_DIS
DLY_CTR
370
DLY2N
AND
DLY_01
DLY_01b
501
DLY_04
DLY_04b
504
DLY_05
DLY_05b
505
DLY_43
DLY_43b
543
DLY_xx, DLY_xxb
380
Pulse generating circuit
SEL
CALIB_ON

CLOCK GENERATING CIRCUIT FOR DRIVING PIXEL

CROSS REFERENCE TO RELATED APPLICATION

This application claims priority from Republic of Korea Patent Application No. 10-2020-0055908, filed on May 11, 2020, which is hereby incorporated by reference in its entirety.

BACKGROUND

1. Field of Technology

The present disclosure relates to a technology for generating a clock for driving a light emitting diode included in a pixel of a display device.

2. Description of the Prior Art

A light emitting diode (LED) panel may include one or more light-emitting diodes (LEDs) in each pixel.

A data driving device for driving the LED panel may express image data, that is, grayscale values, by adjusting the amount of power supplied to the light emitting diode in each pixel. Methods of adjusting the amount of power supplied to the light emitting diode may include a method of adjusting the magnitude of a voltage supplied to the light emitting diode, a method of adjusting the magnitude of a current supplied to the light emitting diode, and a method of adjusting the time of a current supplied to the light emitting diode.

A method of adjusting the time of a current supplied to the light emitting diode may be referred to as a "pulse width modulation (PWM) method." In the PWM method, the data driving device counts a driving clock, and the data driving device may supply current to the light emitting diode in each pixel until a count value reaches a specific grayscale value of each pixel. In addition, when the count value reaches the specific grayscale value, the data driving device may reset the count value, and may recount the driving clock for the next grayscale value.

The data driving device may receive a data clock from a controller, and may receive image data according to the data clock. In addition, the data driving device may generate a driving clock using the data clock.

However, in order to generate a driving clock using the data clock, conventional data driving devices used to include a phase detector (PD) and a multi-stage delay chain in which the delay time is adjusted by an up-signal or a down-signal, which is generated by the phase detector. However, this structure may have a problem of increasing power consumption. A number of delay units (or delay cells) for delaying an input signal by a predetermined unit are included in the multi-stage delay chain. This is due to the fact that all delay units must always be driven according to the up/down-signal in the multi-stage delay chain structure so that a delay cell that is not required to operate is driven as well.

In this regard, the present embodiment provides a clock generation technology capable of generating a driving clock for controlling voltage or current to drive a light emitting diode and reducing power consumption for generating the driving clock by suppressing driving of unnecessary delay units.

SUMMARY OF THE INVENTION

Against this background, in one aspect, the present disclosure is to provide a technology for generating a driving clock used to control the supply of a driving signal to a pixel from a data clock for receiving image data.

In another aspect, the present disclosure is to provide a technology for generating a delay signal by delaying a window signal, generating sub-signals having at least one pulse from the delay signal, and generating a driving clock by combining the sub-signals.

In another aspect, the present disclosure is to provide a technology for generating a driving clock having a frequency corresponding to P times the frequency of the data clock (where "P" is a natural number of 1 or higher).

In another aspect, the present disclosure is to provide a technology for adjusting the degree of delay until the driving clock has a target frequency and, if the frequency of the driving clock reaches the target frequency, disabling some of delay circuits.

In view of the foregoing, in an aspect, the present disclosure provides a clock generating circuit comprising: a signal delay circuit configured to receive a window signal corresponding to one cycle of a data clock received together with image data and to generate a plurality of delay signals and a plurality of inverse delay signals by delaying the window signal; a pulse generating circuit configured to generate a plurality of sub-signals, each having one pulse by respectively combining the plurality of delay signals and the plurality of inverse delay signals; and a signal combination circuit configured to generate a driving clock for driving a pixel using the plurality of sub-signals.

In the clock generating circuit, the signal combination circuit may generate a plurality of clocks by combining some of the plurality of sub-signals, may output one of the plurality of clocks as the driving clock, and may output another of the plurality of clocks as a counter clock to count the window signal.

In the clock generating circuit, the signal combination circuit may generate the driving clock such that the driving clock has a predetermined number of pulses in one cycle of the data clock or at a high level of the window signal.

The clock generating circuit may further include a calibration initialization circuit configured to generate a driving clock mask signal for initializing the signal combination circuit, and the signal combination circuit may stop generating the driving clock for initialization according to the driving clock mask signal.

In the clock generating circuit, the signal combination circuit may generate a single-level signal, instead of the driving clock, in case of initialization.

The clock generating circuit may further include a calibration selection circuit configured to receive a calibration start signal for starting generation of the driving clock and to transmit the window signal or the data clock to the signal delay circuit according to the calibration start signal.

In the clock generating circuit, the signal delay circuit, when receiving the data clock, may delay the data clock, instead of the window signal, to generate the plurality of delay signals and the plurality of inverse delay signals.

In the clock generating circuit, the signal delay circuit may include a plurality of delay units connected in series with each other, and, in order to generate one delay signal, one of the plurality of delay units delays another delay signal received from another delay unit by one unit.

In the clock generating circuit, the one delay unit may generate one inverse delay signal by inverting the one delay signal, and the other delay unit may generate another inverse delay signal by inverting the other delay signal, and the pulse generating circuit may generate one sub-signal by combining the one inverse delay signal and the other delay signal using a pulse generating unit inside the pulse generating circuit.

In the clock generating circuit, the pulse generating unit may perform an AND operation on the one delay signal and the other inverse delay signal to generate the one sub-signal.

In the clock generating circuit, the pulse generating circuit may include a plurality of pulse generating units, and the signal combination circuit may include a first signal combination circuit configured to generate a first clock by combining sub-signals generated by odd-numbered pulse generating units, and second signal combination circuit configured to generate a second clock by combining sub-signals generated by even-numbered pulse generating units.

In the clock generating circuit, the signal combination circuit may output the first clock as the driving clock, and may output the second clock as a counter clock for counting the window signal.

In the clock generating circuit, the driving clock may have a frequency corresponding to N times the frequency of the data clock (where N is a natural number of 1 or higher).

Another embodiment provides a clock generating circuit for generating a second clock having a target frequency corresponding to P times the frequency of a first clock (where P is a natural number of 1 or higher), which may include: a signal delay circuit configured to receive a window signal having a pulse corresponding to one cycle of the first clock and to generate a plurality of delay signals and a plurality of inverse delay signals by delaying the window signal; a pulse generating circuit configured to generate a plurality of sub-signals, each having one pulse by respectively combining the plurality of delay signals and the plurality of inverse delay signals; and a signal combination circuit configured to generate one clock using the plurality of sub-signals and output the one clock as the second clock, wherein the signal delay circuit repeatedly adjusts a delay time for the window signal until the frequency of the one clock reaches the target frequency.

In the clock generating circuit, the first clock may be a communication clock for image data and the second clock may be a driving clock used to control supply of a driving signal for displaying an image using the image data.

In the clock generating circuit, the signal delay circuit may comprise a plurality of delay units configured to generate the plurality of delay signals. Here, some of the plurality of delay units may be disabled when the frequency of the one clock reaches the target frequency and the second clock may be generated based on a delay signal generated by an enabled delay unit among the plurality of delay units.

In the clock generating circuit, the pulse generating circuit may include a plurality of pulse generating units configured to generate the plurality of sub-signals. Here, some of the plurality of pulse generating units may be disabled when the frequency of the one clock reaches the target frequency and the second clock may be generated by a combination of the sub-signals generated by enabled pulse generating units among the plurality of pulse generating units.

In the clock generating circuit, some of the odd-numbered pulse generating units among the plurality of pulse generating units may be disabled when the frequency of the one clock reaches the target frequency and the second clock may be generated by a combination of the sub-signals generated by enabled pulse generating units among the odd-numbered pulse generating units.

In the clock generating circuit, the signal delay circuit may comprise a plurality of delay units configured to delay the window signal by a unit time in order to generate the plurality of delay signals and each delay unit may comprise a plurality of delay sub-units therein configured to determine the unit time. The unit time may be determined by enabling or disabling the plurality of delay sub-units.

In the clock generating circuit, the signal delay circuit may enable only a delay sub-unit that initially receives the window signal, among the plurality of delay sub-units, in order to delay the window signal by a minimum.

As described above, according to the present embodiment, when the frequency of the driving clock reaches a target frequency, some of delay circuits are disabled, thereby reducing power consumption for generating the driving clock.

In addition, according to the present embodiment, a clock generating device may comprise only digital circuits and this allows facilitating its design.

DETAILED DESCRIPTION OF THE EXEMPLARY EMBODIMENTS

Figure 1:
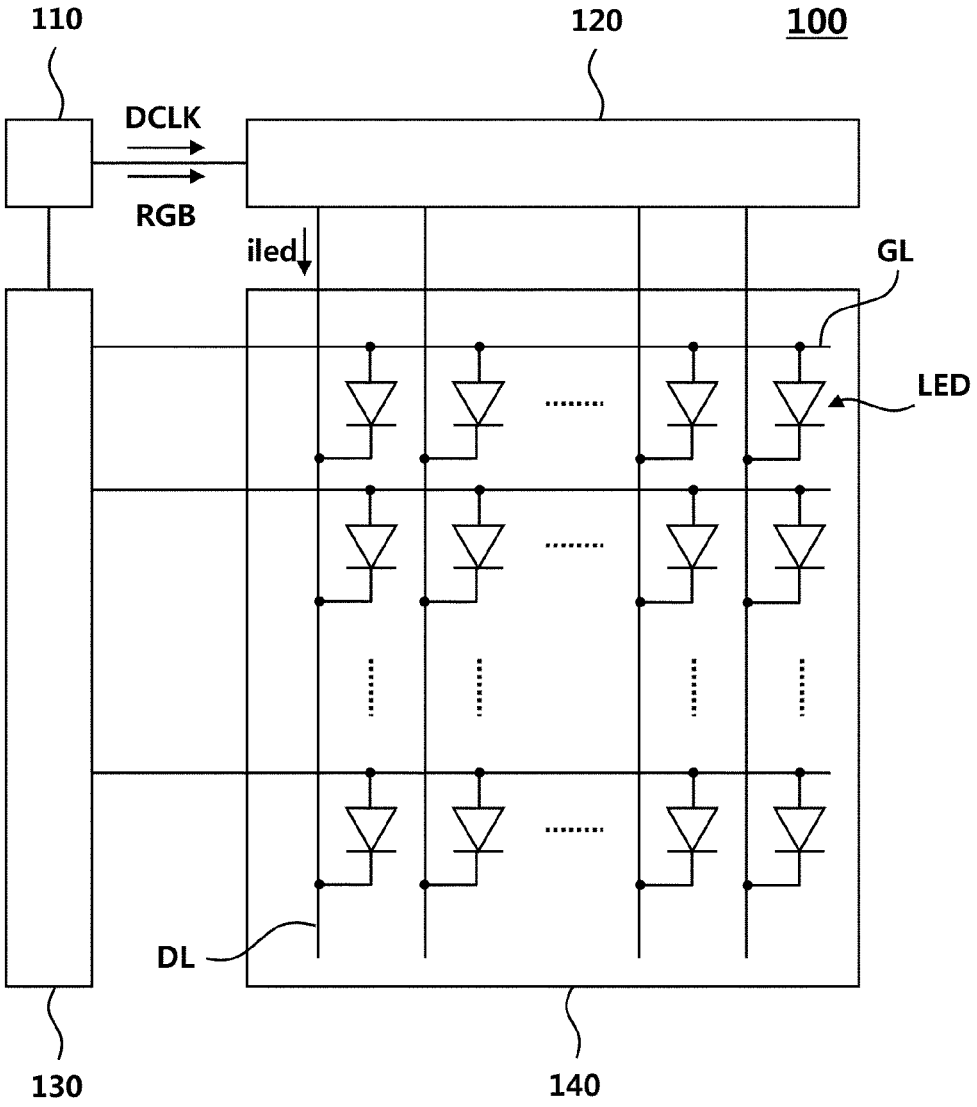
FIG. 1 is a diagram illustrating the configuration of a display device according to an embodiment.

FIG. 1 is a diagram illustrating the configuration of a display device according to an embodiment.

Referring to FIG. 1, a display device 100 may include a controller 110, a data driving device 120, a gate driving device 130, a panel 140, and the like.

One or more light-emitting diodes (LEDs) LED may be disposed in each pixel on the panel 140. Light emitting diodes LED may be arranged in the form of a matrix.

Data lines DL may be arranged on the panel 140 so as to extend in one direction (for example, in the vertical direction in FIG. 1), and gate lines GL may be arranged thereon so as to extend in another direction (for example, in the horizontal direction in FIG. 1). In addition, one electrode (e.g., a cathode) of the light emitting diode LED may be connected to the data line DL, and the other electrode (e.g., an anode) of the light emitting diode LED may be connected to the gate line GL.

The gate driving device 130 may select one gate line GL from among the plurality of gate lines GL, and may supply a specific voltage (e.g., a high driving voltage VDD or low driving voltage VSS) thereto.

In addition, the data driving device 120 may serve as a source for supplying a driving current iled to the light emitting diode LED so that current flows through the light emitting diode LED that is connected to the gate line GL, or may serve as a sink for the driving current iled from the light emitting diode LED.

The controller 110 may transmit image data RGB and a data clock DCLK to the data driving device 120. In addition, the data driving device 120 may receive image data RGB according to the data clock DCLK, and may control the driving current iled to be supplied to each pixel according to the image data RGB.

Figure 2:
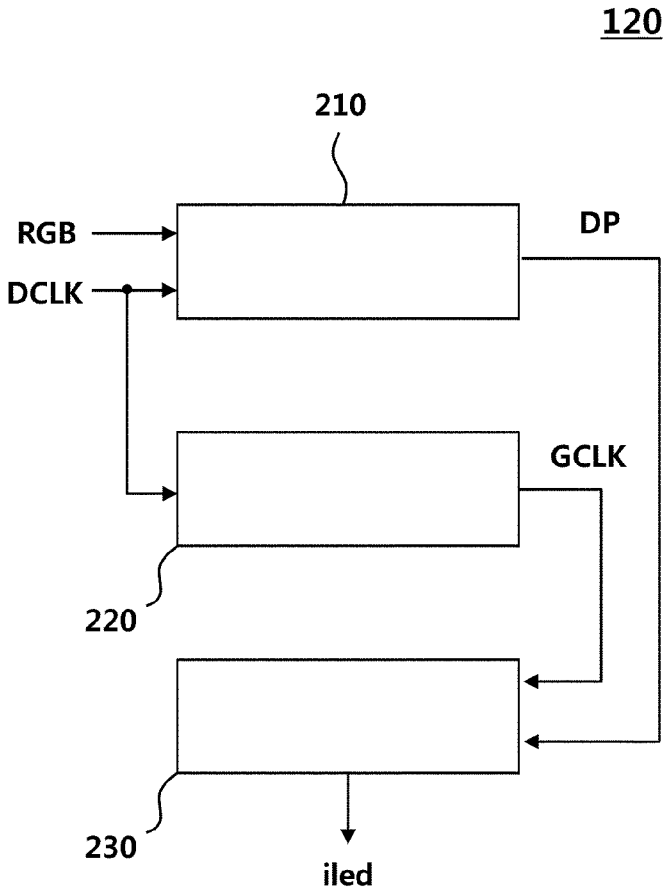
FIG. 2 is a diagram illustrating the configuration of a data driving device according to an embodiment.

FIG. 2 is a diagram illustrating the configuration of a data driving device according to an embodiment.

Referring to FIG. 2, the data driving device 120 may include a data receiving circuit 210, a clock generating circuit 220, a pixel driving circuit 230, and the like.

The data receiving circuit 210 may receive image data RGB according to a data clock DCLK received from a controller. Then, the data receiving circuit 210 may extract pixel data DP corresponding to the grayscale value of each pixel from the image data RGB, and may transmit the same to the pixel driving circuit 230.

The pixel driving circuit 230 may identify a grayscale value of each pixel, which is included in the pixel data DP, and may adjust the amount of driving power to be supplied to each pixel depending on the grayscale value. For example, the pixel driving circuit 230 may increase the amount of driving power as the grayscale value increases, and may reduce the amount of driving power as the grayscale value decreases.

Assuming that the driving voltage supplied to the light emitting diode disposed in each pixel is constant, the amount of driving power supplied to each pixel may be determined according to the magnitude of the driving current iled supplied to each pixel. In addition, the pixel driving circuit 230 may control the grayscale value of each pixel by adjusting the magnitude of the driving current iled supplied to each pixel.

The pixel driving circuit 230 may control the magnitude of the driving current iled supplied to each pixel by adjusting the time for supplying the driving current iled within a predetermined time. This method may be referred to as a "pulse width modulation (PWM) method". In the PWM method, the ratio of the time for supplying the driving current iled to a predetermined time is sometimes referred to as "duty", and the pixel driving circuit 230 may control the grayscale value of each pixel by adjusting the duty. For example, if the grayscale value is high, the pixel driving circuit 230 may increase the duty, and if the grayscale value is low, the pixel driving circuit 230 may reduce the duty.

The pixel driving circuit 230 may implement the PWM method using clock. The pixel driving circuit 230 may adjust the supply time of the driving current iled by counting the clock, thereby controlling the magnitude of the driving current iled. When the grayscale value is high, a count value of the clock increases, and accordingly, the duty and the driving current iled may increase. When the grayscale value is low, a count value of the clock decreases, and accordingly, the duty and the driving current iled may be reduced. Here, the pixel driving circuit 230 may count using a pulse of the clock, and may count based on a rising edge or a falling edge of the pulse. In addition, a count value of the clock (the number of counts) may be equal to or proportional to the grayscale value.

For example, the pixel driving circuit 230 may count the clock, may compare a count value with a grayscale value (or a value proportional to the grayscale value), and may supply the driving current iled to the pixel until the count value becomes equal to the grayscale value (or the value proportional to the grayscale value). In the case of 8-bit image data and a grayscale value of 0 to 255, the count value may be between 0 and 255. For counting the 8-bit image data, the clock may include at least 255 pulses. When the count value becomes equal to a specific value, the pixel driving circuit 230 may reset the count, and may restart the count in order to drive another pixel. At this time, the pixel driving circuit 230 needs a clock, which may be referred to as a "driving clock GCLK".

The clock generating circuit 220 may generate a driving clock GCLK using a data clock DCLK. The cycle of transmitting/receiving image data and the cycle of driving the pixels arranged on the panel must be substantially the same, or must have a relationship of a constant multiple. To this end, the clock generating circuit 220 may generate a driving clock GCLK related to the cycle of driving the pixels using a data clock DCLK related to the cycle of transmitting/receiving image data.

Figure 3:
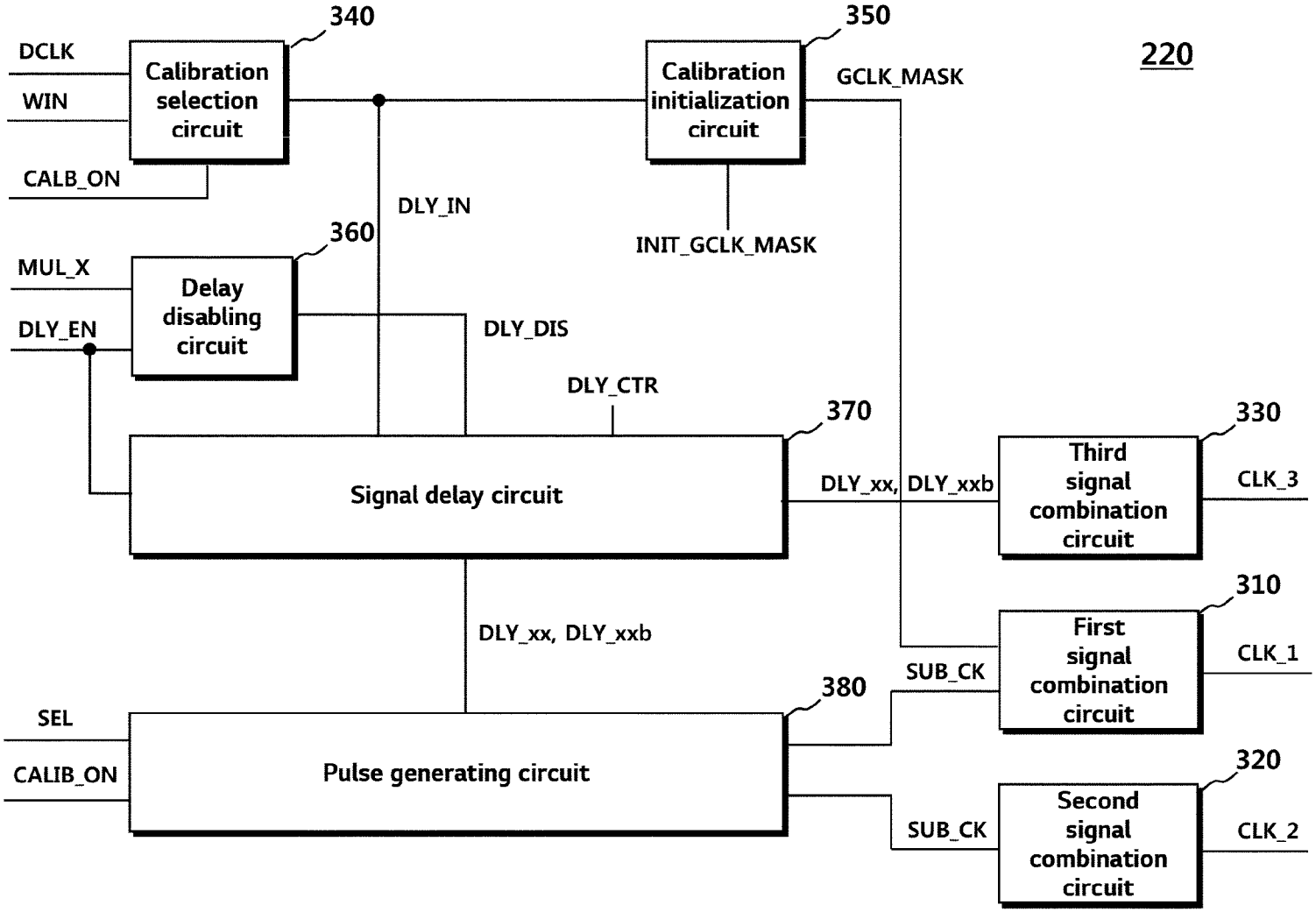
FIG. 3 is a diagram illustrating the configuration of a clock generating circuit according to an embodiment.

FIG. 3 is a diagram illustrating the configuration of a clock generating circuit according to an embodiment.

Referring to FIG. 3, the clock generating circuit 220 may include a first signal combination circuit 310, a second signal combination circuit 320, a third signal combination circuit 330, a calibration selection circuit 340, a calibration initialization circuit 350, a delay disabling circuit 360, a signal delay circuit 370, and a pulse generating circuit 380.

The clock generating circuit 220 may generate a driving clock GCLK from a data clock DCLK. The data clock DCLK may be synchronized with image data, and may be received by the clock generating circuit 220. The pixel driving circuit may read out image data according to the data clock DCLK. The data clock DCLK may be a communication clock for image data. The driving clock GCLK may be used to control supply of a driving signal (e.g., a driving voltage or a driving current) for displaying image data. Here, in order to generate the driving clock GCLK, the clock generating circuit 220 may use the data clock DCLK itself, but the present disclosure is not limited thereto, and the clock generating circuit 220 may use a window signal WIN. The window signal WIN may be a signal having a pulse corresponding to one cycle of the data clock DCLK, and may be a signal that is a source for generating the driving clock GCLK.

The signal delay circuit 370 may receive a delay input signal DLY_IN from the calibration selection circuit 340.

The delay input signal DLY_IN is a signal transmitted from the calibration selection circuit 340 to the signal delay circuit 370, and may include a data clock DCLK or a window signal WIN depending on the selection of the calibration selection circuit 340. The signal delay circuit 370 may receive a delay input signal DLY_IN, that is, any one of a data clock DCLK and a window signal WIN, and may perform delay.

Thus, the signal delay circuit 370 may receive a data clock DCLK itself or a window signal WIN having a pulse corresponding to one cycle of the data clock DCLK from the calibration selection circuit 340. The signal delay circuit 370 may generate a plurality of delay signals DLY_xx by repeatedly delaying the data clock DCLK or the window signal WIN. The signal delay circuit 370 may generate a plurality of inverse delay signals DLY_xxb by inverting the respective delay signals. The signal delay circuit 370 may output a plurality of delay signals DLY_xx or a plurality of inverse delay signals DLY_xxb to the pulse generating circuit 380 or the third signal combination circuit 330.

In addition, the signal delay circuit 370 may receive a delay enabling signal DLY_EN from the outside. The signal delay circuit 370 may receive a delay disabling signal DLY_DIS from the delay disabling circuit 360. The signal delay circuit 370 may enable or turn on some of a plurality of delay units included therein according to the delay enabling signal DLY_EN, and may disable or turn off some of the plurality of delay units according to the delay disabling signal DLY_DIS.

In addition, the signal delay circuit 370 may adjust the degree of delay of the delay input signal DLY_IN according to a delay control signal DLY_CTR. The signal delay circuit 370 may delay the delay input signal DLY_IN through a plurality of delay units that are connected in series therein. The more delay units the signal delay circuit 370 enables, the more delay units the delay input signal DLY_IN passes through, thereby increasing the delay. The fewer delay units the signal delay circuit 370 enables, the fewer delay units the delay input signal DLY_IN passes through, thereby reducing the delay. The delay input signal DLY_IN is delayed by a predetermined degree each time it passes through the delay units as described above, and the degree of delaying the delay input signal DLY_IN by each delay unit, that is, a unit of delay, may be adjusted by the delay control signal DLY_CTR.

The pulse generating circuit 380 may receive a plurality of delay signals DLY_xx and a plurality of inverse delay signals DLY_xxb from the signal delay circuit 370. The pulse generating circuit 380 may generate a plurality of sub-signals SUB_CK having one or more pulses by combining the plurality of delay signals DLY_xx and the plurality of inverse delay signals DLY_xxb. In addition, the pulse generating circuit 380 may transmit the sub-signals SUB_CK to the first signal combination circuit 310 and the second signal combination circuit 320.

In addition, the pulse generating circuit 380 may enable or disable a plurality of pulse generating units included therein through a calibration start signal CALB_ON. In addition, the pulse generating circuit 380 may enable or disable a plurality of pulse generating units through a selection signal SEL. In some cases, one of either the calibration start signal CALB_ON or the selection signal SEL may disable all of the pulse generating units, or the calibration start signal CALB_ON may disable some of the pulse generating units, and the selection signal SEL may disable the remaining pulse generating units. In the latter case, the calibration start signal CALB_ON may control enablement of even-numbered pulse generating units, and the selection signal SEL may control enablement of odd-numbered pulse generating units. Thus, the calibration start signal CALB_ON or the selection signal SEL may disable (mask) some of the pulse generating units, thereby reducing power consumption of the pulse generating circuit 380.

Meanwhile, the signal delay circuit 370 may repeat adjustment of the delay of the delay input signal DLY_IN until the frequency of the driving clock GCLK reaches a target frequency. In order to use the driving clock GCLK as a driving signal for driving a pixel (e.g., a PWM signal), the driving signal, including a large number of pulses, is required to be counted. Therefore, the driving clock GCLK may have a target frequency corresponding to P times the frequency of the data clock DCLK (where "P" is a natural number of 1 or higher). That is, the driving clock GCLK may be multiplied. To this end, the driving clock GCLK must have enough pulses to count the driving signal, and the frequency must be increased according thereto. The signal delay circuit 370 may adjust the delay of the delay input signal DLY_IN until the driving clock GCLK has sufficient pulses or a target frequency. Until that time, the signal delay circuit 370 may repeat the adjustment of the delay for the delay input signal DLY_IN.

In addition, when the frequency of the driving clock GCLK reaches the target frequency, some of the delay units of the signal delay circuit 370 may be disabled. This is due to the fact that the disabled delay units no longer need to operate for generation of the driving clock GCLK. Enablement and disablement of the delay units of the signal delay circuit 370 may be determined by a delay enabling signal DLY_EN and a delay disabling signal DLY_DIS.

Furthermore, when the frequency of the driving clock GCLK reaches the target frequency, some of the pulse generating units of the pulse generating circuit 380 may be disabled. This is due to the fact that the disabled pulse generating units no longer need to operate for generation of the driving clock GCLK. Enablement and disablement of the pulse generating units of the pulse generating circuit 380 may be determined by a selection signal SEL and a calibration start signal CALB_ON.

The signal combination circuits 310 to 330 may combine a plurality of delay signals DLY_xx and a plurality of inverse delay signals DLY_xxb to generate a driving clock GCLK so that the driving clock GCLK has a predetermined number of pulses. Specifically, the signal combination circuits 310 to 330 may receive a plurality of delay signals DLY_xx and a plurality of inverse delay signals DLY_xxb from the signal delay circuit 370, or may receive a plurality of sub-signal SUB_CK from the pulse generating circuit 380. The first signal combination circuit 310 among the signal combination circuits 310 to 330 may receive and combine a plurality of sub-signals SUB_CK to generate a first clock CLK_1. The second signal combination circuit 320 may receive and combine a plurality of sub-signals SUB_CK to generate a second clock CLK_2. The third signal combination circuit 330 may receive and combine a plurality of delay signals DLY_xx and a plurality of inverse delay signals DLY_xxb to generate a third clock CLK_3.

Here, the first signal combination circuit 310 may combine a plurality of sub-signals SUB_CK generated by odd-numbered pulse generating units to generate a first clock CLK_1, and the second signal combination circuit 320 may combine a plurality of sub-signals SUB_CK generated by even-numbered pulse generating units to generate a second clock CLK_2. The third signal combination circuit 330 may generate a third clock CLK_3 having a frequency twice the frequency of the data clock DCLK.

The signal combination circuits 310 to 330 may generate a plurality of clocks, one of the plurality of clocks may be used as a driving clock GCLK, and another of the plurality of clocks may be used as a counter clock for counting the window signal WIN. In this drawing, the first clock CLK_1 may be used as a driving clock GCLK, and the second clock CLK_2 may be used as a counter clock.

The calibration selection circuit 340 may receive a calibration start signal CALB_ON, and may start generating a driving clock GCLK. This is due to the fact that the driving clock GCLK is able to be generated only when the calibration selection circuit 340 transmits one of the data clock DCLK and the window signal WIN to the signal delay circuit 370. The calibration selection circuit 340 may transmit any one of the data clock DCLK and the window signal WIN to the signal delay circuit 370 according to the calibration start signal CALB_ON. If the calibration start signal CALB_ON is 1, the window signal WIN may be output, and if the calibration start signal CALB_ON is 0, the data clock DCLK may be output.

The calibration initialization circuit 350 may initialize the signal combination circuits 310 to 330 through a driving clock mask signal GCLK_MASK. The signal combination circuits 310 to 330 may be initialized by stopping generating the driving clock GCLK upon receiving the driving clock mask signal GCLK_MASK. The signal combination circuits 310 to 330 may generate a single-level signal (e.g., a signal having a low level or high level, which lasts for a predetermined time), instead of generating the clocks CLK_1 to CLK_3, and may output the same. The calibration initialization circuit 350 may initialize only some of the signal combination circuits 310 to 330, and in this drawing, the first signal combination circuit 310 may be initialized by the calibration initialization circuit 350.

The delay disabling circuit 360 may transmit a delay disabling signal DLY_DIS to the signal delay circuit 370. The delay enabling signal DLY_EN may enable or turn on some of a plurality of delay units included in the signal delay circuit 370. The delay disabling signal DLY_DIS may disable or turn off some of the plurality of delay units.

The delay disabling circuit 360 may determine how much to enable or disable the delay units of the signal delay circuit 370 through a frequency multiplication signal MUL_X. The frequency multiplication signal MUL_X may indicate how many times the driving clock GCLK, which is to be ultimately generated, must be multiplied compared to the data clock DCLK. Here, multiplication may be understood as increasing the frequency of the driving clock GCLK to be higher than the frequency of the data clock DCLK. If the frequency multiplication signal MUL_X has a high frequency, the driving clock GCLK must have many pulses and the signal must be much delayed, so many delay units may be enabled. On the other hand, if the frequency multiplication signal MUL_X has a low frequency, the driving clock GCLK must have few pulses and the signal must be little delayed, so fewer delay units may be enabled.

Meanwhile, the clock generating circuit 220 may generate a driving clock GCLK having a target frequency corresponding to P times the frequency of the data clock DCLK (where "P" is a natural number of 1 or higher). The clock generating circuit 220 may continuously generate a first clock CLK_1, which is selected as the driving clock GCLK, until the first clock CLK_1 has a target frequency. During that time, the clock generating circuit 220 may receive a delay control signal DLY_CTR, and may control the delay of the signal delay circuit 370. If the first clock CLK_1 does not reach the target frequency, the signal delay circuit 370 may adjust the unit of delay according to the delay control signal DLY_CTR. The clock generating circuit 220 may repeat this operation until the first clock CLK_1 reaches the target frequency and is then able to be used as a driving clock GCLK.

In addition, when the first clock CLK_1 reaches the target frequency, that is, if the first clock CLK_1 has a number of pulses that are enough to count the PWM signal, the signal delay circuit 370 may disable some of the plurality of internal delay units that delay the delay input signal DLY_IN. When some of the plurality of delay units are disabled, power consumption of the signal delay circuit 370 may be reduced to correspond thereto. In addition, when the first clock CLK_1 reaches the target frequency, that is, if the first clock CLK_1 has a number of pulses that are enough to count the PWM signal, the pulse generating circuit 380 may disable some of the plurality of internal pulse generating units that generate sub-signals by combining the delay signal and the inverse delay signal. When some of the plurality of pulse generating units are disabled, power consumption of the pulse generating circuit 380 may be reduced to correspond thereto.

Figure 4:
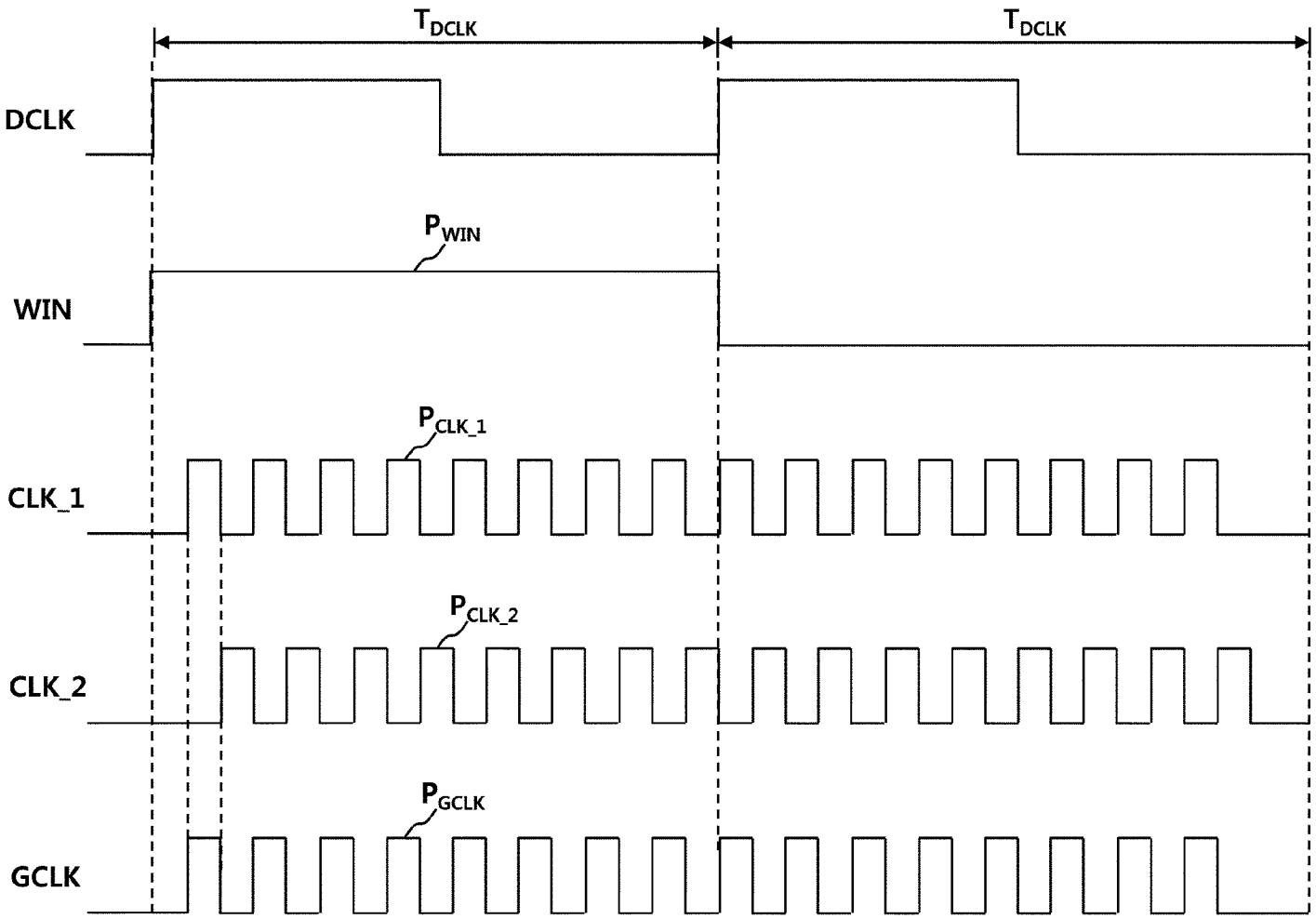
FIG. 4 is a diagram illustrating waveforms of clock signals including a data clock, a first clock, a second clock, and a driving clock, and a window signal according to an embodiment.

FIG. 4 is a diagram illustrating waveforms of clock signals including a data clock, a first clock, a second clock, and a driving clock, and a window signal according to an embodiment.

Referring to FIG. 4, waveforms of a data clock DCLK, a window signal WIN, a first clock CLK_1, a second clock CLK_2, and a driving clock GCLK are illustrated.

The window signal WIN may include a pulse PWIN corresponding to the cycle TDCLK of the data clock DCLK. The pulse PWIN may indicate the period in which a signal rises from a low level to a high level and then remains at the changed high level. Therefore, the pulse width of the window signal WIN may be substantially the same as the cycle TDCLK of the data clock DCLK.

Meanwhile, the first clock CLK_1 and the second clock CLK_2 may be configured such that the pulse PCLK_1 of the first clock CLK_1 and the pulse PCLK_2 of the second clock CLK_2 alternate with each other. That is, the phases of the first clock CLK_1 and the second clock CLK_2 may not match each other, so the first clock CLK_1 and the second clock CLK_2 may alternate with each other. This is due to the fact that the first clock CLK_1 is generated by odd-numbered pulse generating units of the pulse generating circuit and the second clock CLK_2 is generated by even-numbered pulse generating units of the pulse generating circuit. This will be described with reference to FIGS. 9 and 10.

The driving clock GCLK may be any one of a plurality of clocks generated by a signal combination circuit. One of the plurality of clocks generated by the signal combination circuit may be used as a driving clock GCLK, and the remaining clocks may be used as counter clocks for counting the window signal WIN. Here, the first clock CLK_1, which is generated by the first signal combination circuit using a plurality of sub-signals of the odd-numbered pulse generating units, may be used as a driving clock. The second clock CLK_2, which is generated by the second signal combination circuit using a plurality of sub-signals of the even-numbered pulse generating units, may be used as a counter clock. Accordingly, the pulse PGCLK of the driving clock GCLK may be substantially the same as the pulse PCLK_1 of the first clock CLK_1.

Figure 5:
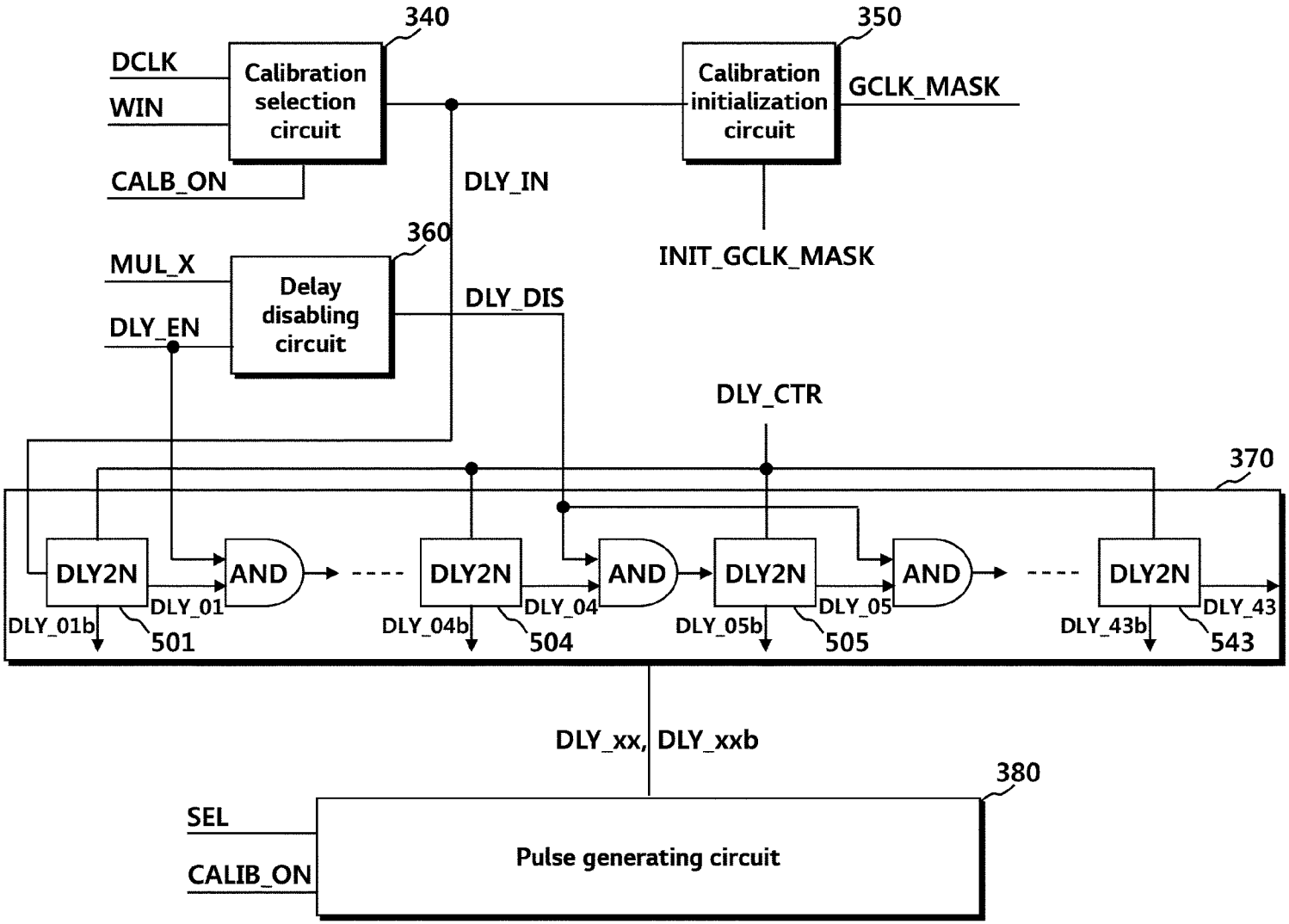
FIG. 5 is a diagram illustrating the configuration of a clock generating circuit including a detailed configuration of a signal delay circuit according to an embodiment.

FIG. 5 is a diagram illustrating the configuration of a clock generating circuit including a detailed configuration of a signal delay circuit according to an embodiment.

Referring to FIG. 5, a signal delay circuit 370 may include a plurality of delay units (DLY2N) 501, . . . , 504, 505, . . . , and 543 therein. The plurality of delay units 501, . . . , 504, 505, . . . , and 543 may be connected in series to each other in a cascade manner One delay unit among the plurality of delay units 501, . . . , 504, 505, . . . , and 543 may generate one delay signal by receiving another delay signal from a preceding delay unit connected in series and delaying the same by a predetermined unit. The one delay signal may be delayed by a predetermined unit by a subsequent delay unit, thereby generating another delay signal. At the same time, each delay unit may generate an inverse delay signal by digitally inverting the delay signal. The inverse delay signal may have a logic level opposite that of the delay signal.

In FIG. 5, a fourth delay unit 504 may generate a fourth delay signal DLY_04, and may transmit the same to a fifth delay unit 505. At the same time, the fourth delay unit 504 may generate a fourth inverse delay signal DLY_04*b*. Subsequently, the fifth delay unit 505 may delay the fourth delay signal DLY_04 to generate a fifth delay signal DLY_05, and may transmit the fifth delay signal DLY_05 to a sixth delay unit (not shown). At the same time, the fifth delay unit 505 may generate a fifth inverse delay signal DLY_05*b*. The above operation may be continuously performed through the first delay unit 501 to the 43rd delay unit 543. In addition, the signal delay circuit 370 may transmit a plurality of delay signals DLY_xx and a plurality of inverse delay signals DLY_xxb to the pulse generating circuit 380.

In addition, the plurality of delay units 501, . . . , 504, 505, . . . , and 543 may receive a delay control signal DLY_CTR for adjusting the unit of delay. The delay control signal DLY_CTR may adjust the unit of delay of each delay unit according to data included in the delay control signal DLY_CTR.

Meanwhile, the plurality of delay units 501, . . . , 504, 505, . . . , and 543 may further include AND gates AND between the delay units. The AND gate AND may serve to connect or disconnect the respective delay units according to logic values of a delay enabling signal DLY_EN and a delay disabling signal DLY_DIS. The AND gate AND may receive a delay enabling signal DLY_EN and a delay disabling signal DLY_DIS depending on the position thereof.

For example, AND gates AND connected with the first delay unit 501 to the third delay unit (not shown) may receive a delay enabling signal DLY_EN, and AND gates AND connected with the fourth delay unit 504 to the 43rd delay unit 543 may receive a delay disabling signal DLY_DIS. If the delay enabling signal DLY_EN has a logic value of 1, the first delay unit 501 to the fourth delay unit 504 may be enabled to then be electrically conducted to each other. If the delay enabling signal DLY_EN has a logic value of 0, the first delay unit 501 to the fourth delay unit 504 may be disabled to then be disconnected from each other. In addition, if the delay disabling signal DLY_DIS has a logic value of 1, the fifth delay unit 505 to the 43rd delay unit 543 may be enabled to then be conducted to each other. If the delay disabling signal DLY_DIS has a logic value of 0, the fifth delay unit 505 to the 43rd delay unit 543 may be disabled to then be disconnected from each other.

Figure 6:
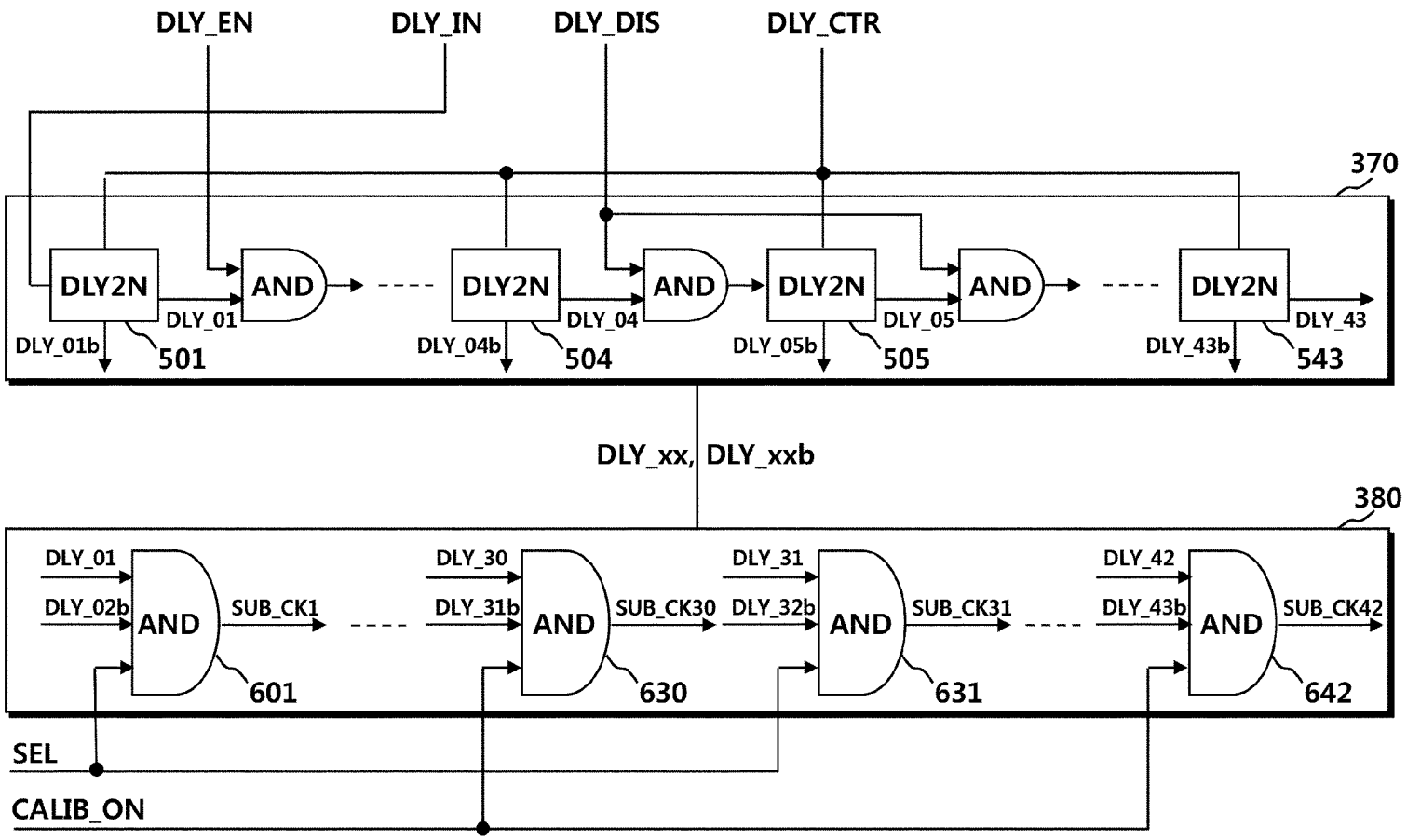
FIG. 6 is a diagram illustrating the configuration of a clock generating circuit including detailed configurations of a signal delay circuit and a pulse generating circuit according to an embodiment.

FIG. 6 is a diagram illustrating the configuration of a clock generating circuit including detailed configurations of a signal delay circuit and a pulse generating circuit according to an embodiment.

Referring to FIG. 6, a pulse generating circuit 380 may include a plurality of pulse generating units 601, . . . , 630, 631, . . . , and 642 therein. The plurality of pulse generating units 601, . . . , 630, 631, . . . , and 642 may be configured independently without being connected to each other, and may generate a plurality of sub-signals SUB_CK1, . . . , SUB_CK30, SUB_CK31, . . . , and SUB_CK42.

One of the plurality of pulse generating units 601, . . . , 630, 631, . . . , and 642 may receive a delay signal and an inverse delay signal from two or more of the plurality of delay units 501, . . . , 504, 505, . . . , and 543. One pulse generating unit may generate a sub-signal by combining the delay signal and the inverse delay signal. In order to combine the delay signal and the inverse delay signal, one pulse generating unit may perform an AND operation using an AND gate AND. Then, one sub-signal may have one or more pulses. Sub-signals generated by the respective pulse generating units may have the same number of pulses, but the phases thereof may be different from each other.

In FIG. 6, the first pulse generating unit 601 may receive and combine a first delay signal DLY_01 and a second inverse delay signal DLY_02*b*. The first pulse generating unit 601 may generate a first sub-signal SUB_CK1 by performing an AND operation on the first delay signal DLY_01 and the second inverse delay signal DLY_02*b*. Similarly, the 30th pulse generating unit 630, the 31st pulse generating unit 631, and the 42nd pulse generating unit 642 may also generate a 30th sub-signal SUB_CK30, a 31st sub-signal SUB_CK31, and a 42nd sub-signal SUB_CK42, respectively, by performing an AND operation on the delay signals and the inverse delay signals.

Meanwhile, the plurality of pulse generating units 601, . . . , 630, 631, . . . , and 642 may enable or disable some or all of a plurality of pulse generating units included therein through selection signals SEL and calibration start signals CALB_ON. Here, the selection signal SEL may enable or disable odd-numbered pulse generating units. The calibration start signal CALB_ON may enable or disable even-numbered pulse generating units.

In addition, the plurality of pulse generating units 601, . . . , 630, 631, . . . , and 642 may perform an AND operation on the selection signals SEL and the calibration start signals CALB_ON together with the delay signals and inverse delay signals. Therefore, some or all of the plurality of pulse generating units 601, . . . , 630, 631, . . . , and 642 may be enabled or disabled according to the logic values of the selection signals SEL and the calibration start signals CALB_ON.

Figure 7:
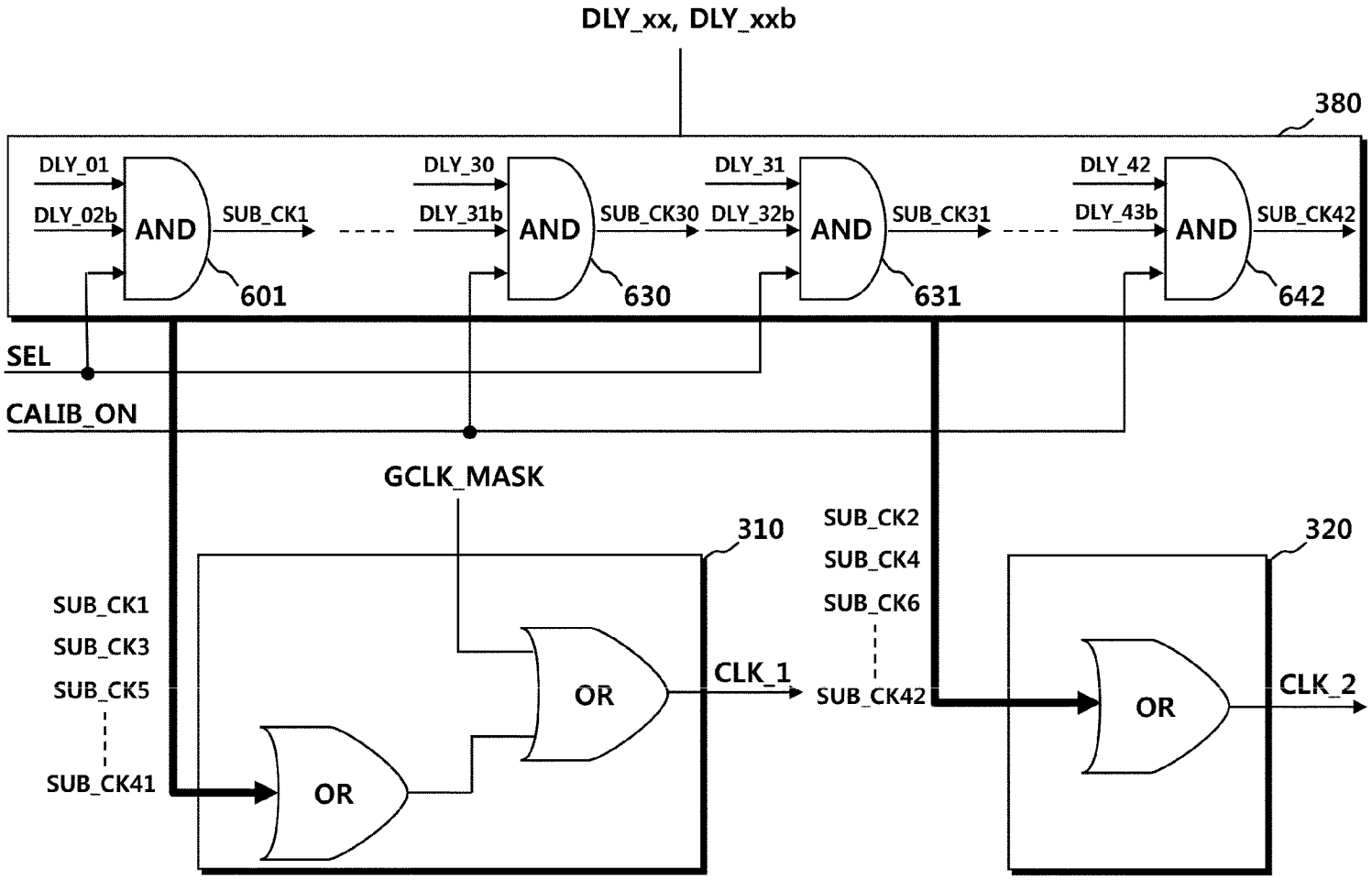
FIG. 7 is a diagram illustrating the configuration of a clock generating circuit including detailed configurations of a first signal combination circuit and a second signal combination circuit according to an embodiment.

FIG. 7 is a diagram illustrating the configuration of a clock generating circuit including detailed configurations of a first signal combination circuit and a second signal combination circuit according to an embodiment.

Referring to FIG. 7, a first signal combination circuit 310 may generate a first clock CLK_1 by combining some of a plurality of sub-signals, and a second signal combination circuit 320 may generate a second clock CLK_2 by combining some of the plurality of sub-signals. The first and second signal combination circuits 310 and 320 may be collectively referred to as a "signal combination circuit".

For example, the pulse generating circuit 380 may include M pulse generating units (where "M" is a natural number of 2 or higher). Then, the first signal combination circuit 310 may generate a first clock CLK_1 by combining sub-signals generated by the Xth pulse generating unit (where "X" is an odd number less than or equal to M). The second signal combination circuit 320 may generate a second clock CLK_2 by combining sub-signals generated by the Yth pulse generating unit (where "Y" is an even number less than or equal to M).

In FIG. 7, the first pulse generating unit 601 and the 31st pulse generating unit 631 are illustrated as odd-numbered pulse generating units, and the 30th pulse generating unit 630 and the 42nd pulse generating unit 642 are illustrated as even-numbered pulse generating units. In addition, the 1st, 3rd, 5th, . . . , and 41st sub-signals SUB_CK1, 3, 5, . . . , and 41 are illustrated as odd-numbered sub-signals generated by the odd-numbered pulse generating units, and the 2nd, 4th, 6th, . . . , and 42nd sub-signals SUB_CK2, 4, 6, . . . , and 42 are illustrated as even-numbered sub-signals generated by the even-numbered pulse generating units.

Next, the signal combination circuit may generate a clock by combining a plurality of sub-signals. The signal combination circuit may perform an OR operation on the plurality of sub-signals to combine the plurality of sub-signals.

For example, the first signal combination circuit 310 may receive the 1st, 3rd, 5th, . . . , and 41st sub-signals SUB_CK1, 3, 5, . . . , and 41, which are odd-numbered sub-signals, and may perform an OR operation thereon. Since the respective sub-signals have one or more pulses having different phases, a first clock CLK_1 having a plurality of pulses may be generated by combining the plurality of sub-signals. Similarly, the second signal combination circuit 320 may receive the 2nd, 4th, 6th, . . . , and 42nd sub-signals SUB_CK2, 4, 6, . . . , and 42, which are even-numbered sub-signals, and may perform an OR operation thereon. Since the respective sub-signals have one or more pulses having different phases, a second clock CLK_2 having a plurality of pulses may be generated by combining the plurality of sub-signals. Then, the first clock CLK_1 may be used as a driving clock GCLK, and the second clock CLK_2 may be used as a counter clock.

Meanwhile, the first signal combination circuit 310 may receive a driving clock mask signal GCLK_MASK in order to mask the first signal combination circuit 310. Here, the first signal combination circuit 310 may perform an OR operation on the driving clock mask signal GCLK_MASK. If the logic value of the driving clock mask signal GCLK_MASK is 1, the first clock CLK_1 may output a single level. That is, the first signal combination circuit 310 may be initialized. This initialization operation may be performed in advance before the driving clock GCLK is generated.

Figure 8:
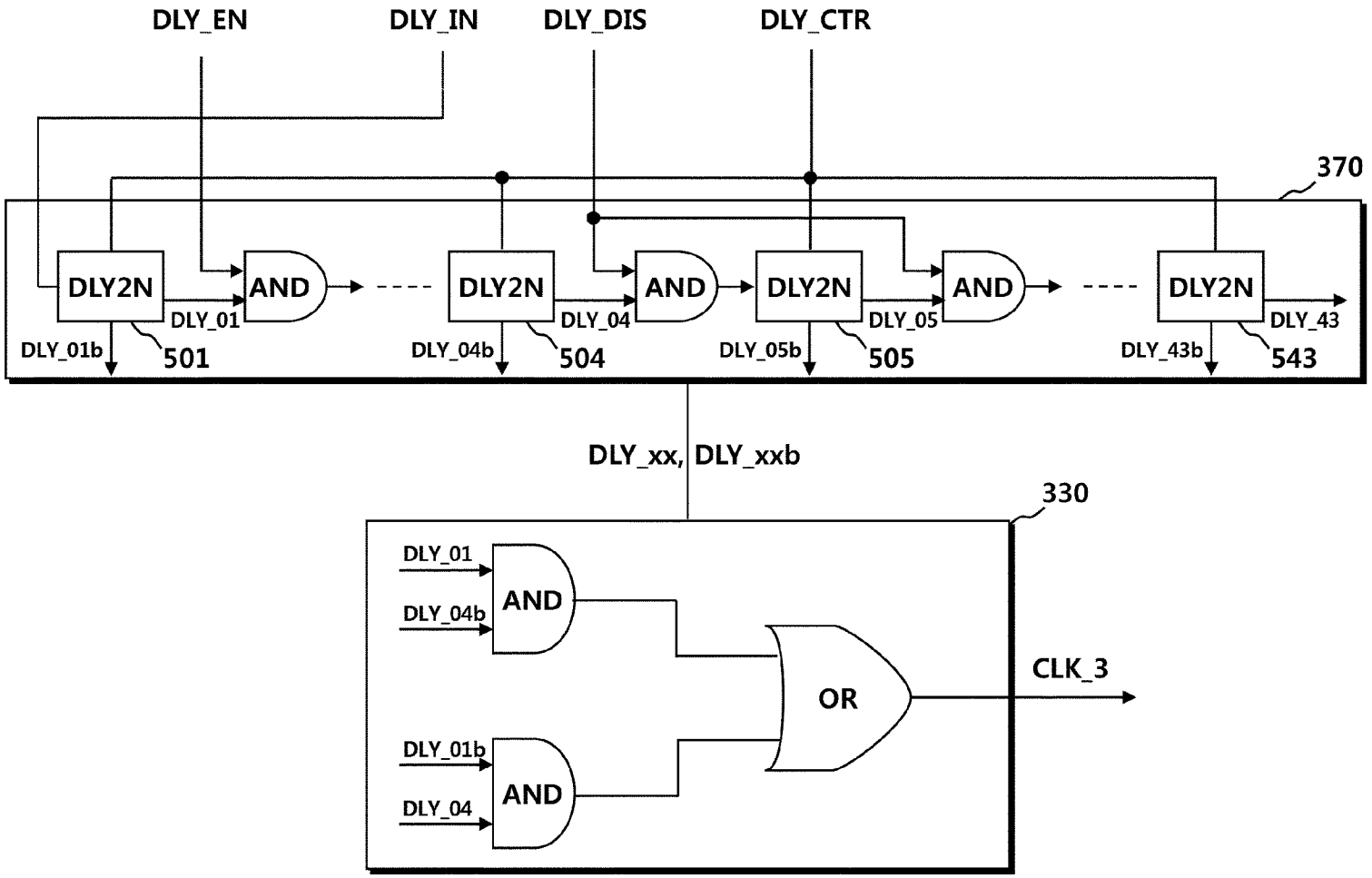
FIG. 8 is a diagram illustrating the configuration of a clock generating circuit including detailed configurations of a third signal combination circuit according to an embodiment.

FIG. 8 is a diagram illustrating the configuration of a clock generating circuit including detailed configurations of a third signal combination circuit according to an embodiment.

Referring to FIG. 8, a third signal combination circuit 330 may generate a third clock CLK_3 by combining some of a plurality of sub-signals. First to third signal combination circuits 310, 320, and 330 may be collectively referred to as a "signal combination circuit".

Like the first and second signal combination circuits, the third signal combination circuit 330 may also generate a third clock CLK_3 by combining a plurality of sub-signals. However, the third signal combination circuit 330 may receive and combine only some specific delay signals and inverse delay signals. For example, this is due to the fact that when the frequency of the driving clock GCLK is not much higher than that of the data clock DCLK, it is not necessary to make many sub-signals while generating countless delay signals. That is, even if there are a few delay signals and inverse delay signals to generate the driving clock GCLK, a number of pulses that are enough to count the PWM signals may be generated. Accordingly, if the frequency of the driving clock GCLK is only twice that of the data clock DCLK, the third signal combination circuit 330 may generate a clock by combining a delay signal and an inverse signal.

In FIG. 8, the third signal combination circuit 330 may generate one sub-signal by performing an AND operation on the first delay signal DLY_01 and the fourth inverse delay signal DLY_04*b*, and may generate the other sub-signal by performing an AND operation on the first inverse delay signal DLY_01*b* and the fourth delay signal DLY_04. One sub-signal and the other sub-signal may have pulses in different phases from each other. The third signal combination circuit 330 may generate a third clock CLK_3 by performing an OR operation on one sub-signal and the other sub-signal.

Figure 9:
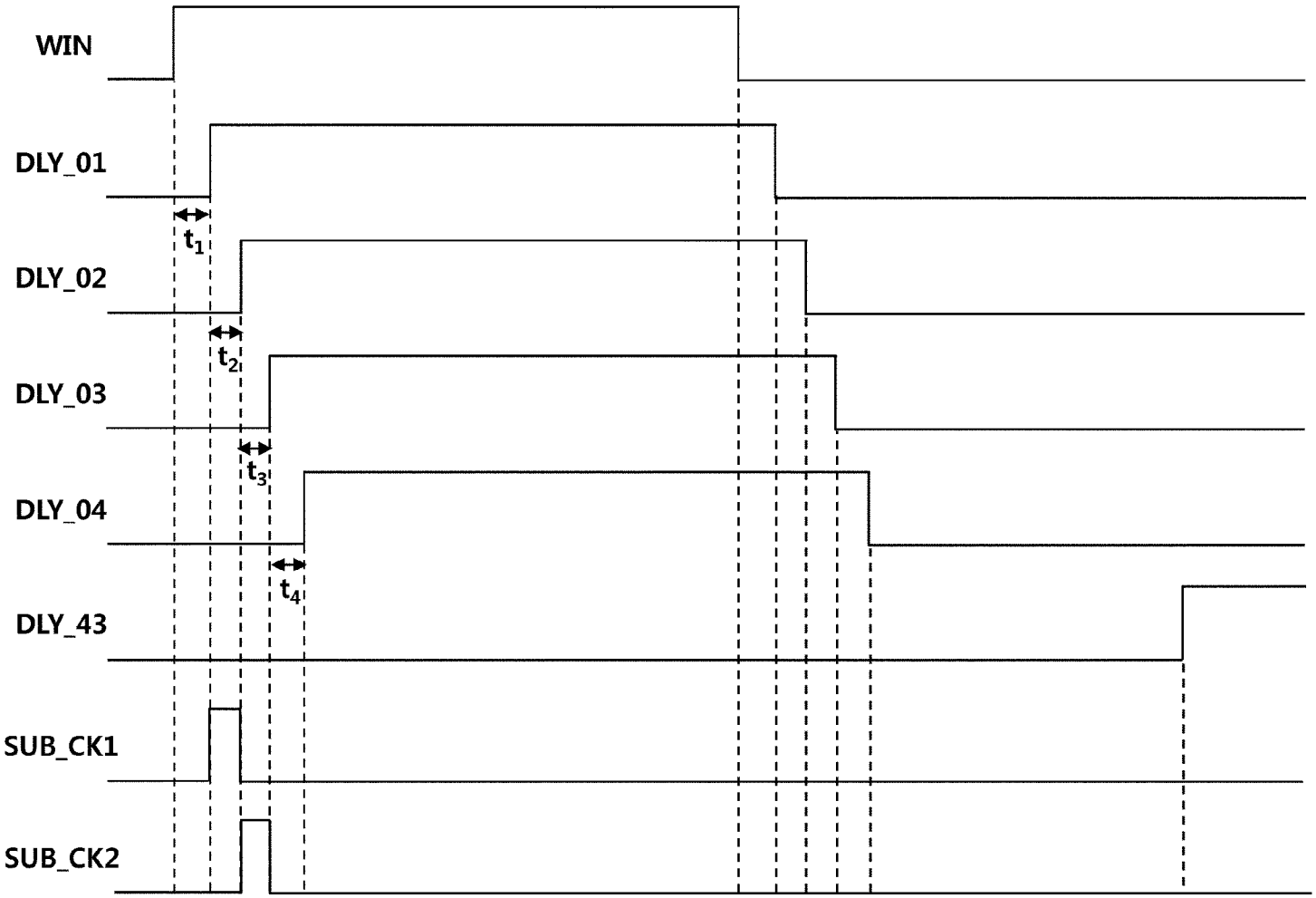
FIG. 9 is a diagram illustrating waveforms of a window signal, delay signals, and sub-signals according to an embodiment.

FIG. 9 is a diagram illustrating waveforms of a window signal, delay signals, and sub-signals according to an embodiment.

Referring to FIG. 9, a window signal WIN, delay signals DLY_01 to DLY_43, and sub-signals SUB_CK1 and SUB_CK2 may have different phases. The delay signals DLY_01 to DLY_43 may be generated whenever the window signal WIN is repeatedly delayed. The sub-signals SUB_CK1 and SUB_CK2 may have one or more pulses through a combination of the delay signals DLY_01 to DLY_43 and inverse signals thereof.

When the window signal WIN passes through a first delay unit of the signal delay circuit, the window signal WIN may be delayed by t1 to generate a first delay signal DLY_01. The first delay signal DLY_01 may have a phase difference of t1 from the window signal WIN.

When the first delay signal DLY_01 passes through a second delay unit of the signal delay circuit, the first delay signal DLY_01 may be delayed by t2 to generate a second delay signal DLY_02. The second delay signal DLY_02 may have a phase difference of t2 from the first delay signal DLY_01.

Similarly, the second delay signal DLY_02 may be delayed by t3 to generate a third delay signal DLY_03, and the third delay signal DLY_03 may be delayed by t4 to generate a fourth delay signal DLY_04. When the window signal WIN passes through all delay units of the signal delay circuit, a 43rd delay signal DLY_43 may be finally generated.

Here, the delay time t1 to t4 of the respective delay signals may correspond to the units of delay by the first to fourth delay units. The units of delay by the respective delay units may be the same or different from each other. Preferably, since a clock having pulses at a predetermined interval must be generated, the units of delay by the respective delay units may be the same. The units of delay by the respective delay units may be determined by a delay control signal received from the outside.

Meanwhile, the sub-signal may be generated by a combination of a delay signal and an inverse delay signal. For example, the first sub-signal SUB_CK1 may be generated by performing an AND operation on the first delay signal DLY_01 and the second inverse delay signal (not shown) (the inverse signal of the second delay signal DLY_02). Then, the first sub-signal SUB_CK1 may be generated to have a pulse at a position at which the first delay signal DLY_01 and the second inverse delay signal (not shown) overlap.

Similarly, the second sub-signal SUB_CK2 may be generated by performing an AND operation on the second delay signal DLY_02 and the third inverse delay signal (not shown) (the inverse signal of the third delay signal DLY_03). Then, the second sub-signal SUB_CK2 may be generated to have a pulse at a position at which the second delay signal DLY_02 and the third inverse delay signal (not shown) overlap.

Figure 10:
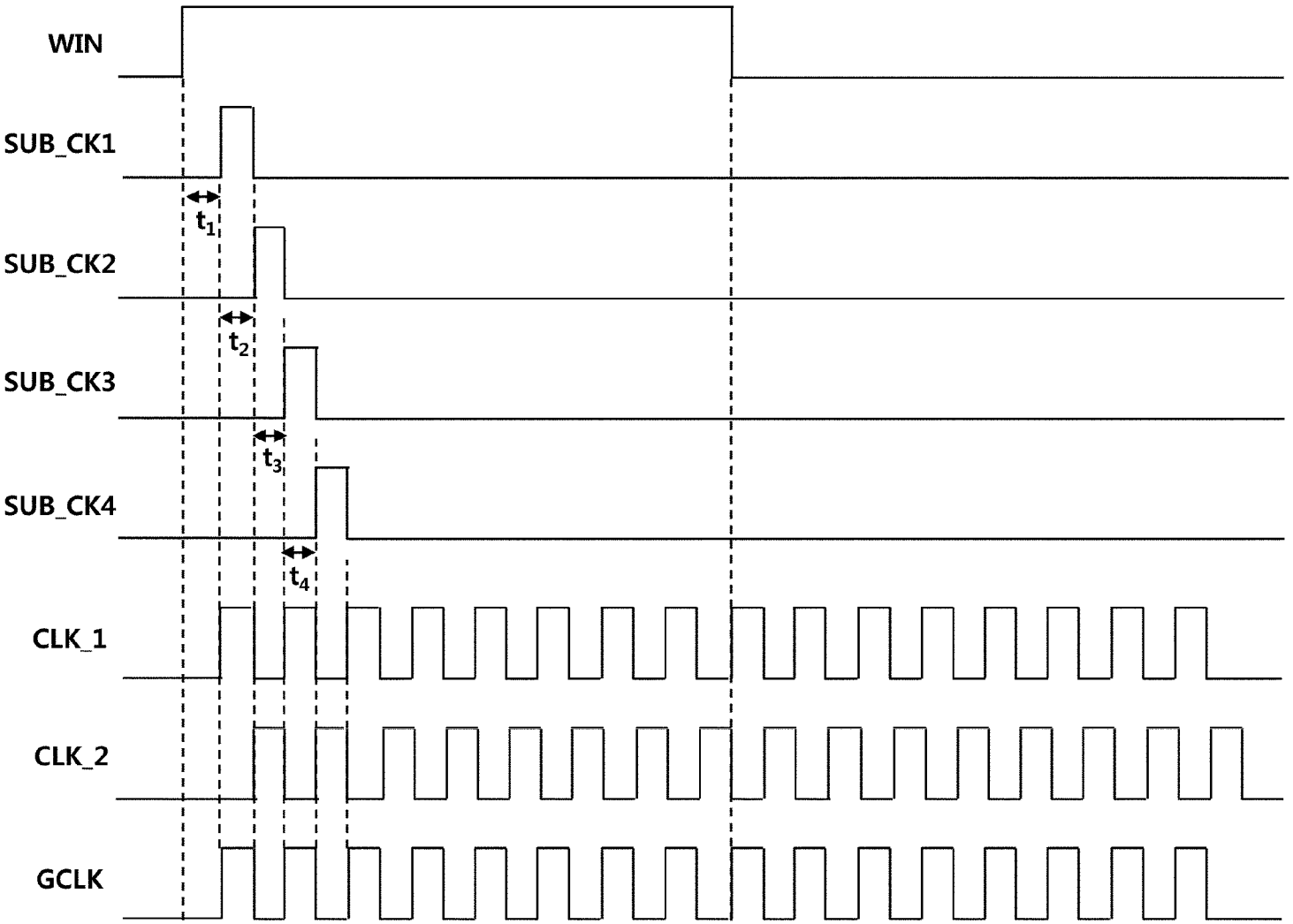
FIG. 10 is a diagram illustrating waveforms of a window signal, sub-signals, a first clock, a second clock, and a driving clock according to an embodiment.

FIG. 10 is a diagram illustrating waveforms of a window signal, sub-signals, a first clock, a second clock, and a driving clock according to an embodiment.

Referring to FIG. 10, a window signal WIN and sub-signal SUB_CK1, SUB_CK2, SUB_CK3, and SUB_CK4 may have different phases. The sub-signals SUB_CK1, SUB_CK2, SUB_CK3, and SUB_CK4 may include at least one pulse. Since the sub-signals SUB_CK1, SUB_CK2, SUB_CK3, and SUB_CK4 are produced by combining delayed signals, the pulses of the respective sub-signals may have different phases.

For example, the first sub-signal SUB_CK1 may be generated by performing an AND operation on the first delay signal and the second inverse delay signal, and may be delayed by t1 compared to the window signal WIN. The second sub-signal SUB_CK2 may be generated by performing an AND operation on the second delay signal and the third inverse delay signal, and may be delayed by t2 compared to the first sub-signal SUB_CK1. The third sub-signal SUB_CK3 may be generated by performing an AND operation on the third delay signal and the fourth inverse delay signal, and may be delayed by t3 compared to the second sub-signal SUB_CK2. The fourth sub-signal SUB_CK4 may be generated by performing an AND operation on the fourth delay signal and the fifth inverse delay signal, and may be delayed by t4 compared to the third sub-signal SUB_CK3.

Meanwhile, the first clock CLK_1 and the second clock CLK_2 may be generated by a combination of a plurality of sub-signals. Here, only some of the sub-signals may be used to generate a clock, instead of using all of the sub-signals.

For example, the first signal combination circuit may receive odd-numbered sub-signals from odd-numbered pulse generating units of the pulse generating circuit, and may combine only the odd-numbered sub-signals, thereby generating the first clock CLK_1. Therefore, the first clock CLK_1 may have a pulse at the same position as the pulse of the first sub-signal SUB_CK1, and may further have a pulse at the same position as the pulse of the third sub-signal SUB_CK3. In addition, the second signal combination circuit may receive even-numbered sub-signals from even-numbered pulse generating units of the pulse generating circuit, and may combine only the even-numbered sub-signals, thereby generating the second clock CLK_2. Therefore, the second clock CLK_2 may have a pulse at the same position as the pulse of the second sub-signal SUB_CK2, and may further have a pulse at the same position as the pulse of the fourth sub-signal SUB_CK4.

One of the first clock CLK_1 and the second clock CLK_2 may be used as a driving clock GCLK. In FIG. 10, the first clock CLK_1 having the pulses of odd-numbered sub-signals may be used as a driving clock GCLK. Accordingly, the driving clock GCLK may be the same as the first clock CLK_1.

Figure 11:
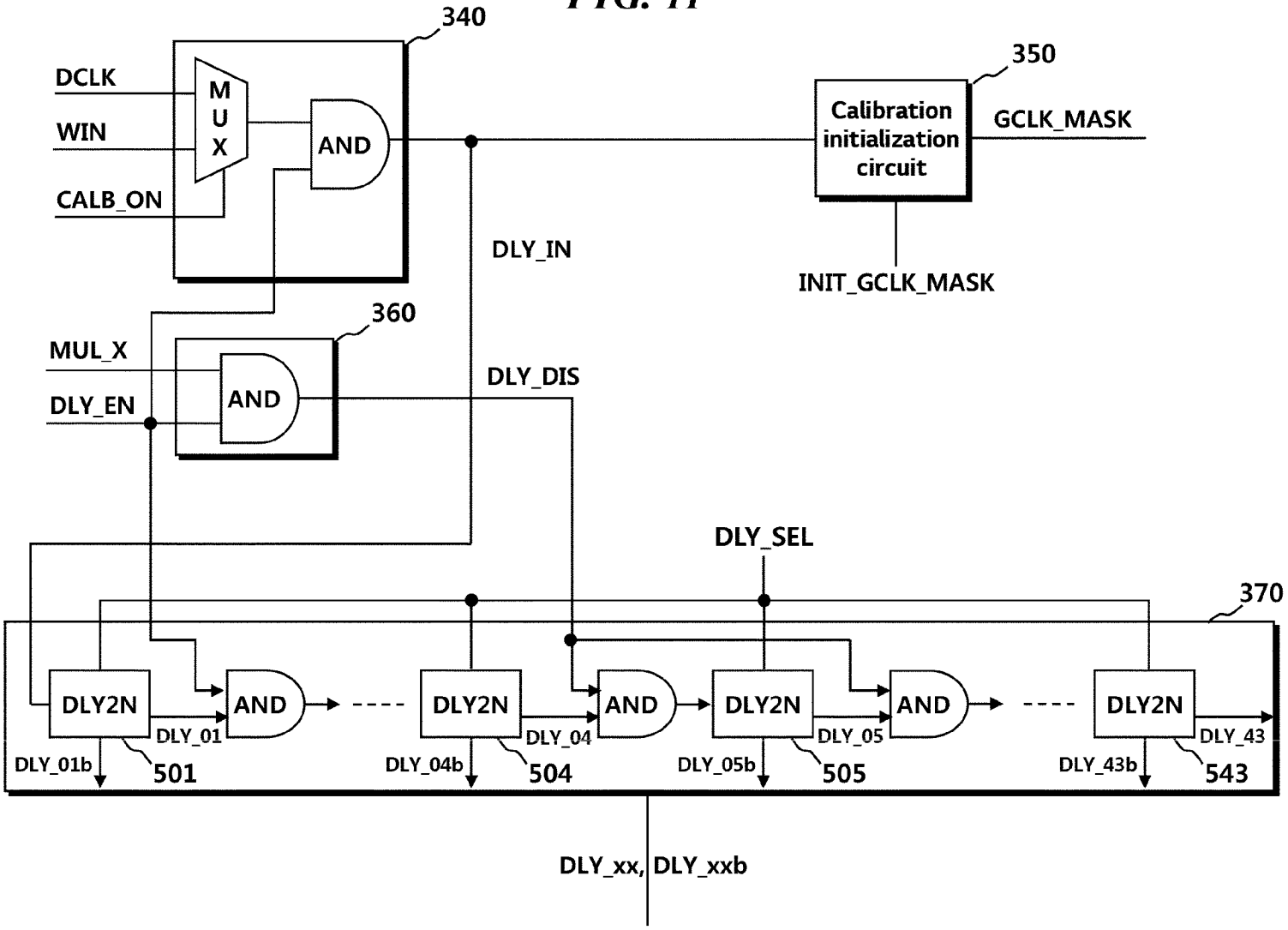
FIG. 11 is a diagram illustrating the configuration of a clock generating circuit including detailed configurations of a calibration selection circuit and a delay disabling circuit according to an embodiment.

FIG. 11 is a diagram illustrating the configuration of a clock generating circuit including detailed configurations of a calibration selection circuit and a delay disabling circuit according to an embodiment.

Referring to FIG. 11, a calibration selection circuit 340 may include a multiplexer MUX and an AND gate AND therein. The calibration selection circuit 340 may receive a data clock DCLK, a window signal WIN, and a calibration start signal CALB_ON through the multiplexer MUX. The calibration selection circuit 340 may select a window signal WIN or a data clock DCLK according to the calibration start signal CALB_ON.

In addition, the calibration selection circuit 340 may receive a delay enabling signal DLY_EN and an output of the multiplexer MUX through the AND gate AND. The calibration selection circuit 340 may or may not output a data clock DCLK or a window signal WIN to the signal delay circuit 370 according to the delay enabling signal DLY_EN.

Meanwhile, the delay disabling circuit 360 may include an AND gate AND therein. The delay disabling circuit 360 may generate a delay disabling signal DLY_DIS through the AND gate AND. The delay disabling circuit 360 may output, as a delay disabling signal DLY_DIS, a result of performing an AND operation on the logic values of the frequency multiplication signal MUL_X and the delay enabling signal DLY_EN.

Figure 12:
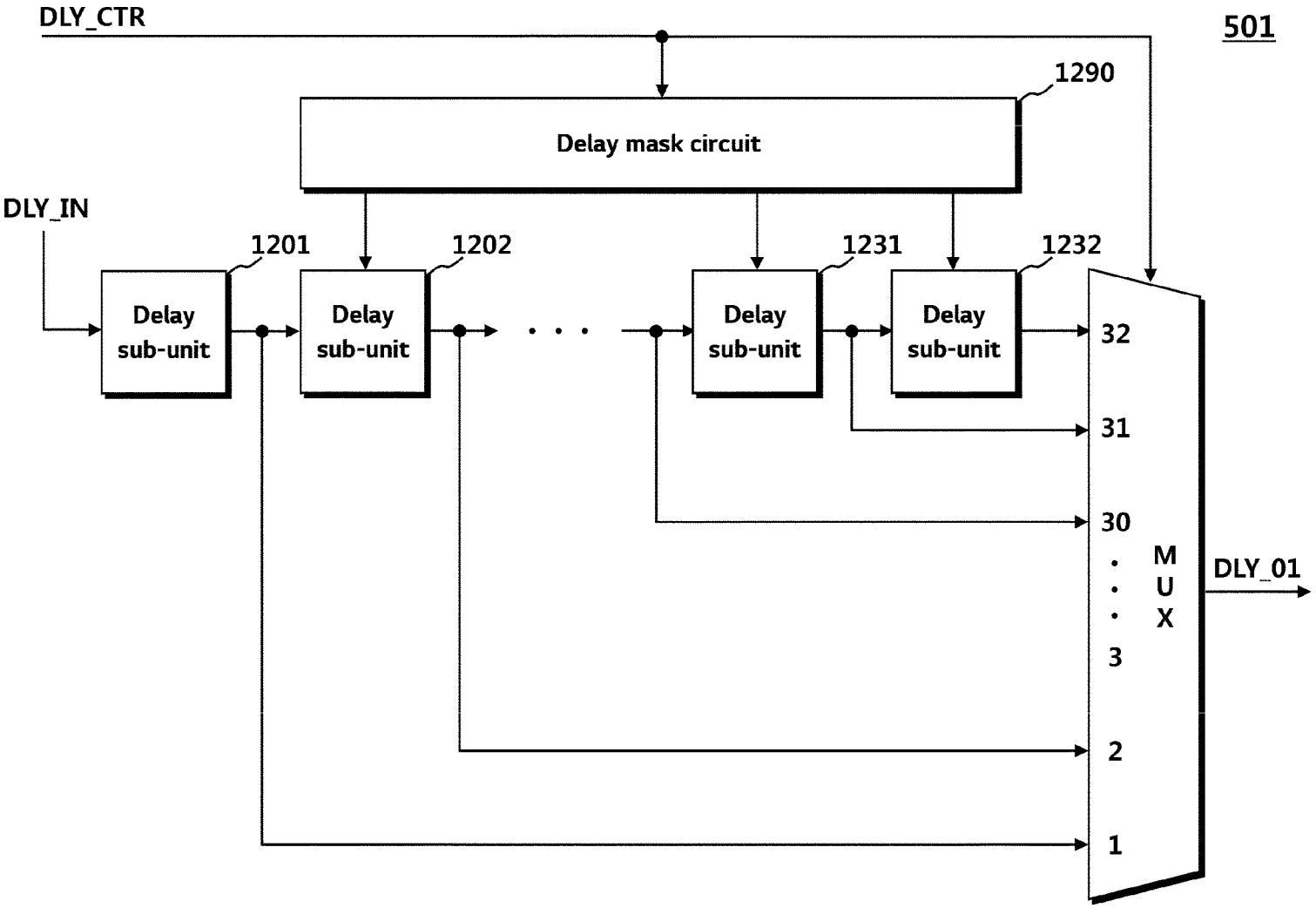
FIG. 12 is a diagram illustrating the configuration of a delay unit according to an embodiment.

FIG. 12 is a diagram illustrating the configuration of a delay unit according to an embodiment.

Referring to FIG. 12, the delay unit may include one or more delay sub-units 1201 to 1232, a delay mask circuit 1290, and a multiplexer MUX. The delay unit may delay a delay input signal DLY_IN through the delay sub-units 1201 to 1232. One delay unit may receive a window signal of the delay input signal DLY_IN, and may delay the same by one unit. Another delay unit may continuously delay the window signal which has already been delayed by one unit. Here, the delay sub-units 1201 to 1232 may determine the one unit, and the one unit may be determined by enabling or disabling some of the delay sub-units 1201 to 1232 by the delay mask circuit 1290.

For example, in the case of the first delay unit 501, the delay sub-units 1201 to 1232 may receive a delay input signal DLY_IN. The delay input signal DLY_IN may be a window signal or a data clock. Here, the following description will be made on the assumption that the window signal is a delay input signal DLY_IN. The first delay sub-unit 1201 may generate a first small delay signal by delaying the window signal. The first small delay signal may be transmitted to a first input terminal of the multiplexer MUX. Subsequently, the second delay sub-unit 1202 may generate a second small delay signal by delaying the first small delay signal. The second small delay signal may be transmitted to a second input terminal of the multiplexer MUX. The remaining delay sub-units may also operate in the same way. Finally, the 32nd delay sub-unit 1232 may generate a 32nd small delay signal by delaying a 31st small delay signal, and may transmit the same to a 32nd input terminal of the multiplexer MUX. As the window signal passes through the respective delay sub-units, the window signal may be delayed longer. When the window signal passes through the last delay sub-unit (e.g., the 32nd delay sub-unit 1232), the window signal is delayed by the maximum that the first delay unit 501 is able to delay. On the other hand, when the window signal passes through only the first delay sub-unit (e.g., the first delay sub-unit 1201), the window signal is delayed by the minimum that the first delay unit 501 is able to delay. The multiplexer MUX may select one of the first to the 32nd small delay signals according to a delay control signal DLY_CTR.

If the first delay unit 501 does not delay the window signal by the maximum, that is, if the first delay unit 501 outputs a small delay signal other than the 32nd small delay signal as the first delay signal DLY_01, the delay mask circuit 1290 may disable some of the delay sub-units 1201 to 1232.

For example, if the first delay unit 501 outputs the second small delay signal as the first delay signal DLY_01, the delay mask circuit 1290 may disable the third delay sub-unit (not shown) to the 32nd delay sub-unit 1232. The delay mask circuit 1290 may receive a delay control signal DLY_CTR, and may enable or disable the delay sub-units 1201 to 1232 according to the delay control signal DLY_CTR. At the same time, the multiplexer MUX may also receive the delay control signal DLY_CTR, and may output one of the first to the 32nd small delay signals as the first delay signal DLY_01 according to the delay control signal DLY_CTR.

As described above, each delay unit may adjust the unit of delay for delaying the signal according to the delay control signal DLY_CTR. This may be implemented by enabling or disabling some of the delay sub-units inside the respective delay units. Therefore, the user is able to easily set the unit of delay, and power consumption for components that are not used for delay may be reduced.

Figure 13:
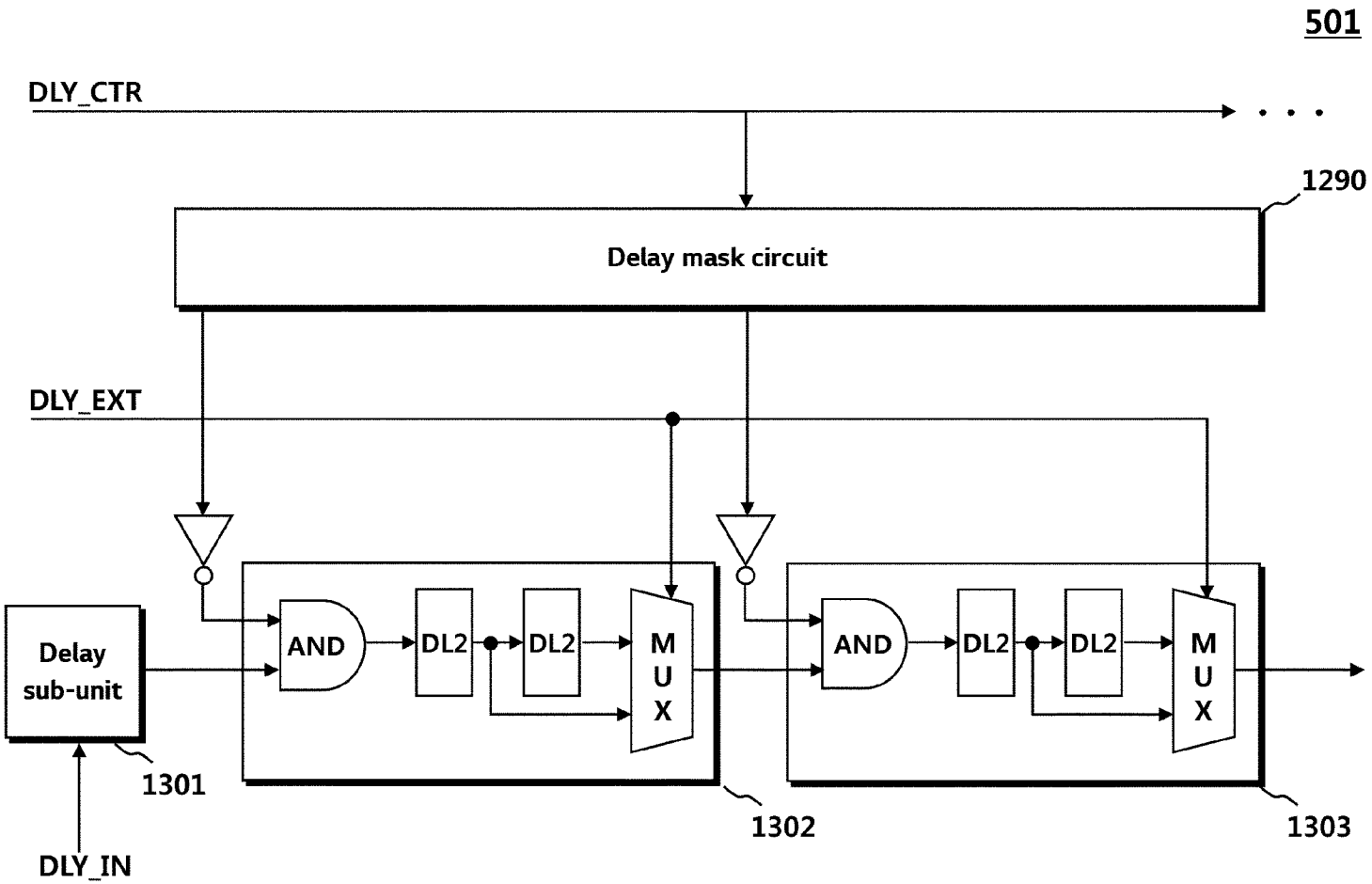
FIG. 13 is a diagram illustrating a detailed configuration of a front end of a delay unit according to another embodiment.
Figure 14:
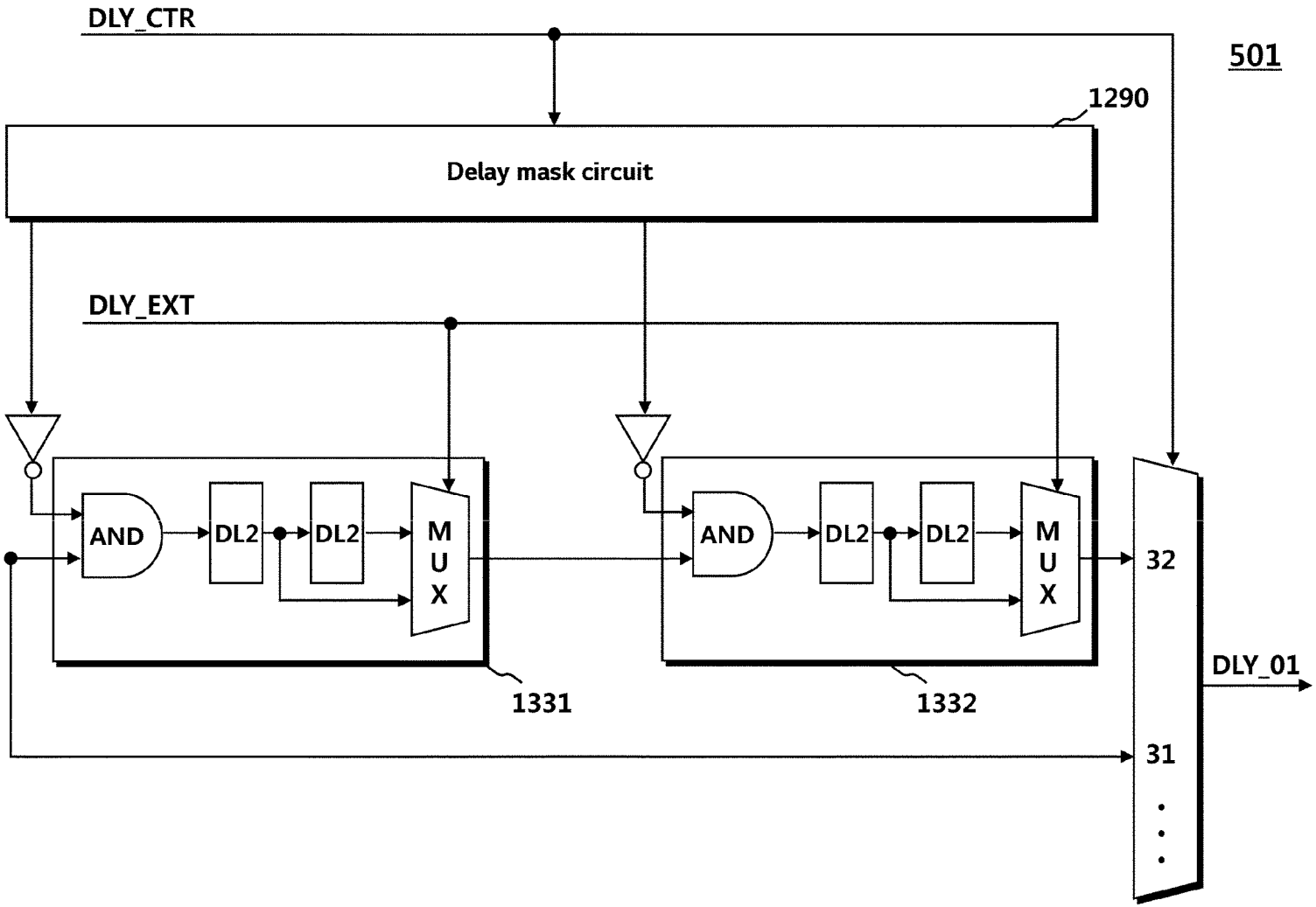
FIG. 14 is a diagram illustrating a detailed configuration of a rear end of a delay unit according to another embodiment.

FIG. 13 is a diagram illustrating a detailed configuration of a front end of a delay unit according to another embodiment, and FIG. 14 is a diagram illustrating a detailed configuration of a rear end of a delay unit according to another embodiment.

Referring to FIGS. 13 and 14, a delay unit according to another embodiment of the present disclosure may include a plurality of delay sub-units capable of extension of a delay. One delay sub-unit included in one delay unit may extend or reduce the degree of small delay. Here, for convenience of explanation, a delay by one delay unit may be referred to as a "large delay", and a delay by a delay sub-unit may be referred to as a "small delay". That is, the large delay may be understood as the degree to be delayed when the delay input signal DLY_IN passes through one delay unit, and the small delay may be understood as the degree to be delayed when the delay input signal DLY_IN passes through one delay sub-unit. One delay sub-unit may include an AND gate AND, a plurality of micro-delay units DL2, and a multiplexer MUX therein in order to extend or reduce the small delay. FIG. 13 illustrates only three delay sub-units included in the front end of the delay unit, and FIG. 14 illustrates only two delay sub-units included in the rear end of the delay unit.

For example, the second delay sub-unit 1302 may receive a first small delay signal from the first delay sub-unit 1301. The first small delay signal may pass through an AND gate AND, a plurality of micro-delay units DL2, and a multiplexer MUX. The second delay sub-unit 1302 may delay the first small delay signal by a small delay to generate a second small delay signal. Here, in order to adjust the degree of the small delay, the second delay sub-unit 1302 may delay the first small delay signal using only one micro-delay unit DL2 or two or more micro-delay units DL2. The more micro-delay units DL2 the first small delay signal passes through, the longer the signal is delayed. In the drawings, only two micro-delay units DL2 may be used. The multiplexer MUX of the first delay sub-unit 1301 may select a first delay signal having passed through one micro-delay unit DL2 or a first delay signal having passed through two micro-delay units DL2.

In addition, the second delay sub-unit 1302 may receive a delay extension signal DLY_EXT, and may select one of the first delay signals having passed through one micro-delay unit DL2 and the first delay signal having passed through two micro-delay units DL2 according to the delay extension signal DLY_EXT.

In addition, each delay sub-unit may receive a mask signal from the delay mask circuit 1290 through an inverter logic gate. The delay sub-unit receiving the mask signal may be enabled or disabled.

Figure 15:
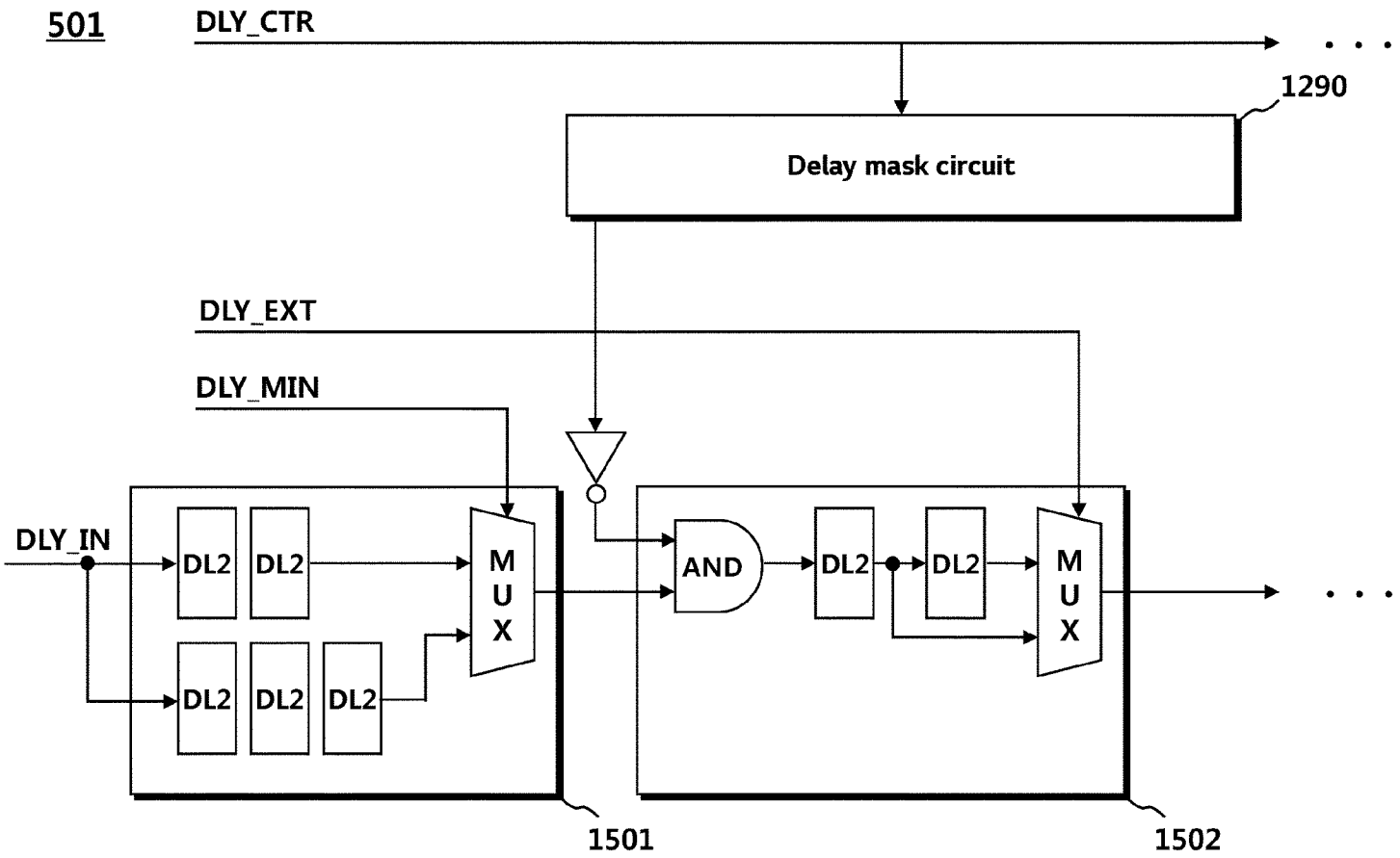
FIG. 15 is a diagram illustrating a delay sub-unit according to another embodiment.

FIG. 15 is a diagram illustrating a delay sub-unit according to another embodiment.

Referring to FIG. 15, according to another embodiment, only a delay unit initially receiving a delay input signal DLY_IN, among the delay units, may be enabled, and the remaining delay units may be disabled. The signal delay circuit may enable only the first delay unit in order to delay the delay input signal DLY_IN (the window signal or the data clock) by a minimum.

For example, the first delay sub-unit 1501 may initially receive a delay input signal DLY_IN. The first delay sub-unit 1501 may include a plurality of micro-delay units DL2 and a multiplexer MUX. The micro-delay unit DL2 may delay the delay input signal DLY_IN, and the degree of delaying the delay input signal DLY_IN may vary depending on the number of micro-delay units DL2 used. In FIG. 15, two micro-delay units DL2 and three micro-delay units DL2 may be included in the first delay sub-unit 1501. The delay input signal DLY_IN may be delayed longer when passing through three micro-delay units DL2 than when passing through two micro-delay units DL2.

In addition, the first delay sub-unit 1501 may receive a minimum delay signal DLY_MIN, and may select one of the signal having passed through two micro-delay units DL2 and the signal having passed through three micro-delay units DL2 according to the minimum delay signal DLY_MIN. The minimum delay signal DLY_MIN is a signal for driving only the first delay unit, and may control the first delay unit 501 to delay the signal by a minimum. At the same time, all of the remaining delay sub-units including the second delay sub-unit 1502 may be disabled.

What is claimed is:

1. A clock generating circuit comprising:

a signal delay circuit configured to receive a window signal corresponding to one cycle of a data clock received together with image data and to generate a plurality of delay signals and a plurality of inverse delay signals by delaying the window signal;

a pulse generating circuit configured to generate a plurality of sub-signals, each having one pulse by respectively combining the plurality of delay signals and the plurality of inverse delay signals; and a signal combination circuit configured to generate a driving clock for driving a pixel using the plurality of sub-signals.

2. The clock generating circuit of claim 1, wherein the signal combination circuit generates a plurality of clocks by combining some of the plurality of sub-signals, outputs one of the plurality of clocks as the driving clock, and outputs another of the plurality of clocks as a counter clock to count the window signal.

3. The clock generating circuit of claim 1, wherein the signal combination circuit generates the driving clock such that the driving clock has a predetermined number of pulses in one cycle of the data clock or at a high level of the window signal.

4. The clock generating circuit of claim 1, further comprising a calibration initialization circuit configured to generate a driving clock mask signal for initializing the signal combination circuit, wherein the signal combination circuit stops generating the driving clock for initialization according to the driving clock mask signal.

5. The clock generating circuit of claim 4, wherein the signal combination circuit generates a single-level signal, instead of the driving clock, in case of initialization.

6. The clock generating circuit of claim 1, further comprising a calibration selection circuit configured to receive a calibration start signal for starting the generation of the driving clock and to transmit the window signal or the data clock to the signal delay circuit according to the calibration start signal.

7. The clock generating circuit of claim 6, wherein the signal delay circuit, when receiving the data clock, delays the data clock, instead of the window signal, to generate the plurality of delay signals and the plurality of inverse delay signals.

8. The clock generating circuit of claim 1, wherein the signal delay circuit comprises a plurality of delay units connected in series with each other, wherein, in order to generate one delay signal, one of the plurality of delay units delays another delay signal received from another delay unit by one unit.

9. The clock generating circuit of claim 8, wherein the one delay unit generates one inverse delay signal by inverting the one delay signal, the other delay unit generates another inverse delay signal by inverting the other delay signal, and the pulse generating circuit generates one sub-signal by combining the one inverse delay signal and the other delay signal using a pulse generating unit inside the pulse generating circuit.

10. The clock generating circuit of claim 9, wherein the pulse generating unit performs an AND operation on the one delay signal and the other inverse delay signal to generate the one sub-signal.

11. The clock generating circuit of claim 9, wherein the pulse generating circuit comprises a plurality of pulse generating units, and wherein the signal combination circuit comprises a first signal combination circuit configured to generate a first clock by combining sub-signals generated by odd-numbered pulse generating units and a second signal combination circuit configured to generate a second clock by combining sub-signals generated by even-numbered pulse generating units.

12. The clock generating circuit of claim 11, wherein the signal combination circuit outputs the first clock as the driving clock and outputs the second clock as a counter clock for counting the window signal.

13. The clock generating circuit of claim 1, wherein the driving clock has a frequency corresponding to N times the frequency of the data clock (where N is a natural number of 1 or higher).

14. A clock generating circuit for generating a second clock having a target frequency corresponding to P times the frequency of a first clock (where P is a natural number of 1 or higher), the clock generating circuit comprising:

a signal delay circuit configured to receive a window signal having a pulse corresponding to one cycle of the first clock and to generate a plurality of delay signals and a plurality of inverse delay signals by delaying the window signal;

a pulse generating circuit configured to generate a plurality of sub-signals, each having one pulse by respectively combining the plurality of delay signals and the plurality of inverse delay signals; and a signal combination circuit configured to generate one clock using the plurality of sub-signals and output the one clock as the second clock, wherein the signal delay circuit repeatedly adjusts a delay time for the window signal until the frequency of the one clock reaches the target frequency.

15. The clock generating circuit of claim 14, wherein the first clock is a communication clock for image data and the second clock is a driving clock used to control supply of a driving signal for displaying an image using the image data.

16. The clock generating circuit of claim 14, wherein the signal delay circuit comprises a plurality of delay units configured to generate the plurality of delay signals, wherein some of the plurality of delay units are disabled when the frequency of the one clock reaches the target frequency and the second clock is generated based on a delay signal generated by an enabled delay unit among the plurality of delay units.

17. The clock generating circuit of claim 14, wherein the pulse generating circuit comprises a plurality of pulse generating units configured to generate the plurality of sub-signals, wherein some of the plurality of pulse generating units are disabled when the frequency of the one clock reaches the target frequency and the second clock is generated by a combination of the sub-signals generated by enabled pulse generating units among the plurality of pulse generating units.

18. The clock generating circuit of claim 17, wherein some of odd-numbered pulse generating units among the plurality of pulse generating units are disabled when the frequency of the one clock reaches the target frequency and the second clock is generated by a combination of the sub-signals generated by enabled pulse generating units among the odd-numbered pulse generating units.

19. The clock generating circuit of claim 14, wherein the signal delay circuit comprises a plurality of delay units configured to delay the window signal by a unit time in order to generate the plurality of delay signals, wherein each delay unit comprises a plurality of delay sub-units therein configured to determine the unit time, and wherein the unit time is determined by enabling or disabling the plurality of delay sub-units.

20. The clock generating circuit of claim 19, wherein the signal delay circuit enables only a delay sub-unit that initially receives the window signal, among the plurality of delay sub-units, in order to delay the window signal by a minimum.

* * * * *